US010041331B2

(12) United States Patent
Ross et al.

(10) Patent No.: US 10,041,331 B2
(45) Date of Patent: Aug. 7, 2018

(54) SHIFTING TOOL ASSEMBLY THAT FACILITATES CONTROLLED PRESSURE EQUALIZATION

(71) Applicant: Halliburton Energy Services, Inc., Houston, TX (US)

(72) Inventors: Colby Munro Ross, Carrollton, TX (US); Gregory William Garrison, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 126 days.

(21) Appl. No.: 14/782,849

(22) PCT Filed: Feb. 18, 2015

(86) PCT No.: PCT/US2015/016284
§ 371 (c)(1),
(2) Date: Oct. 7, 2015

(87) PCT Pub. No.: WO2016/133500
PCT Pub. Date: Aug. 25, 2016

(65) Prior Publication Data

US 2016/0362960 A1 Dec. 15, 2016

(51) Int. Cl.
*E21B 34/14* (2006.01)
*E21B 34/10* (2006.01)
(Continued)

(52) U.S. Cl.
CPC ..... *E21B 34/10* (2013.01); *E21B 33/12* (2013.01); *E21B 34/14* (2013.01); *E21B 47/06* (2013.01);
(Continued)

(58) Field of Classification Search
CPC combination set(s) only.
See application file for complete search history.

(56) References Cited

U.S. PATENT DOCUMENTS 4,520,870 A 6/1985 Pringle
4,928,772 A 5/1990 Hopmann
(Continued)

FOREIGN PATENT DOCUMENTS

WO 2007098392 A2 8/2007
WO 2011063086 A1 5/2011

OTHER PUBLICATIONS

Official Action for AU Patent Application No. 2013252890 dated Apr. 15, 2015.

(Continued)

*Primary Examiner* — Sean D Andrish
(74) *Attorney, Agent, or Firm* — McDermott Will & Emery LLP

(57) ABSTRACT

An exemplary downhole system includes a completion string positioned within a wellbore and providing at least an upper seal bore and a downhole device that includes a sliding sleeve. A service tool is extendable within the completion string and includes a shifting tool assembly and provides a mandrel, a shifting tool coupled to the mandrel, and upper equalization seals arranged on the mandrel and sealingly engageable with the upper seal bore. The shifting tool is engageable with the sliding sleeve to move the downhole device at least partially between a closed position, where a pressure differential between a subterranean formation and an interior of the completion string is assumed by primary sealing elements of the downhole device, and an open position, where the pressure differential is assumed by at least the upper equalization seals.

24 Claims, 10 Drawing Sheets

(51) Int. Cl.
*E21B 33/12* (2006.01)
*E21B 47/06* (2012.01)
*E21B 34/00* (2006.01)

(52) U.S. Cl.
CPC ... *E21B 2034/002* (2013.01); *E21B 2034/007* (2013.01)

(56) References Cited

U.S. PATENT DOCUMENTS

| | | | |
|---|---|---|---|
| 6,198,531 | B1 | 3/2001 | Myrick et al. |
| 6,529,276 | B1 | 3/2003 | Myrick |
| 7,123,844 | B2 | 10/2006 | Myrick |
| 7,711,605 | B1 | 5/2010 | Santeufemia et al. |
| 7,834,999 | B2 | 11/2010 | Myrick et al. |
| 7,911,605 | B2 | 3/2011 | Myrick et al. |
| 7,920,258 | B2 | 4/2011 | Myrick et al. |
| 8,049,881 | B2 | 11/2011 | Myrick et al. |
| 8,225,871 | B2 | 7/2012 | Beall et al. |
| 2007/0177240 | A1 | 8/2007 | Van Beek et al. |
| 2009/0056934 | A1 | 3/2009 | Xu |
| 2009/0182693 | A1 | 7/2009 | Fulton et al. |
| 2009/0219538 | A1 | 9/2009 | Myrick et al. |
| 2009/0219539 | A1 | 9/2009 | Myrick et al. |
| 2010/0042348 | A1 | 2/2010 | Bakker |
| 2010/0153048 | A1 | 6/2010 | Myrick et al. |
| 2012/0067583 | A1 | 3/2012 | Zimmerman et al. |
| 2012/0138311 | A1* | 6/2012 | Stout ..... E21B 34/10 166/373 |
| 2013/0025872 | A1 | 1/2013 | Mailand et al. |

OTHER PUBLICATIONS

Official Action for AU Patent Application No. 2013252767 dated Apr. 15, 2015.

Nelson, M.P. et al., Multivariate Optical Computation for Predictive Spectroscopy, Analytical Chemistry, vol. 70, No. 1, 1998, pp. 73-82.

International Search Report and Written Opinion for PCT/US2015/016284 dated Sep. 25, 2015.

Australian Examination Report from Australian Patent Application No. 2015383158, dated Feb. 8, 2018. 4 pages.

* cited by examiner

SHIFTING TOOL ASSEMBLY THAT FACILITATES CONTROLLED PRESSURE EQUALIZATION

BACKGROUND

In the oil and gas industry, work strings including various downhole devices are often extended downhole within drilled boreholes to perform various wellbore operations. Downhole devices, such as sliding sleeves and ball valves, include primary sealing elements that serve to isolate fluids within or without the work strings. Placing these downhole devices in a downhole environment subjects them to elevated pressures and extreme pressure differentials that threaten the integrity of the primary sealing elements.

For instance, sliding sleeves are typically used in completion assemblies to occlude flow ports that communicate with a surrounding subterranean formation. Subterranean formations can exhibit pressures near 10,000 psi or more, and when the sliding sleeve is in a closed position, a pressure differential is generated across the sliding sleeve between the subterranean formation and the interior of the completion assembly. The primary sealing elements of the sliding sleeve are able to resist fluid migration through the flow ports, and thereby effectively isolate the fluids in the subterranean formation from the interior of the completion assembly. Upon moving the sliding sleeve to an open position, however, the flow ports become exposed and the pressure differential will attempt to equalize at an extremely high rate. Such rapid pressure equalization can have a detrimental impact on the primary sealing elements. For example, rapid pressure equalization can potentially blow out the primary sealing elements or cause seal erosion over time. As a result, the integrity of the primary sealing elements is often compromised and any subsequent use of the downhole device may not be optimal.

In an effort to mitigate the effects of rapid pressure equalization, some sliding sleeve assemblies incorporate a slot defined in the seal bore between the primary seals. While shifting the sliding sleeve between closed and open positions, the slot becomes exposed for a brief period of time to facilitate a small amount of pressure equalization. Another method of mitigating the effects of rapid pressure equalization uses an equalizing port provided adjacent the sliding sleeve. The equalizing port often contains a small ball bearing or a poppet valve that is propped off seat by the sliding sleeve when the sliding sleeve is shifted between closed and open positions. These methods, however, complicate the design of the sliding sleeve assembly and introduce additional leak paths into the interior of the completion assembly.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

This present disclosure is related to downhole tools used in the oil and gas industry and, more particularly, to a shifting tool assembly that controls pressure equalization across downhole devices.

Embodiments of the present disclosure allow downhole tools to be opened or closed under pressure without risking damage to primary sealing elements associated with the given downhole tool. More particularly, downhole tools, such as sliding sleeves, can experience a significant amount of differential pressure and have a tendency to blow out the primary seals when the sliding sleeve is opened, where one or more flow ports are exposed, or closed, where the flow ports are occluded. The equalization pressure can exhaust rapidly through the flow ports and dislodge or otherwise quickly erode the primary seals. According to the present disclosure, a pressure equalizing feature may be incorporated into a shifting tool assembly used to move the sliding sleeve between the open and closed positions. As a result, the differential pressure may be controlled and assumed by pressure equalization seals associated with the shifting tool assembly, and not by the primary seals of the downhole tool being shifted. Any damage sustained by the pressure equalization seals can be addressed upon returning the shifting tool assembly to a surface location following the downhole operation.

Figure 1:
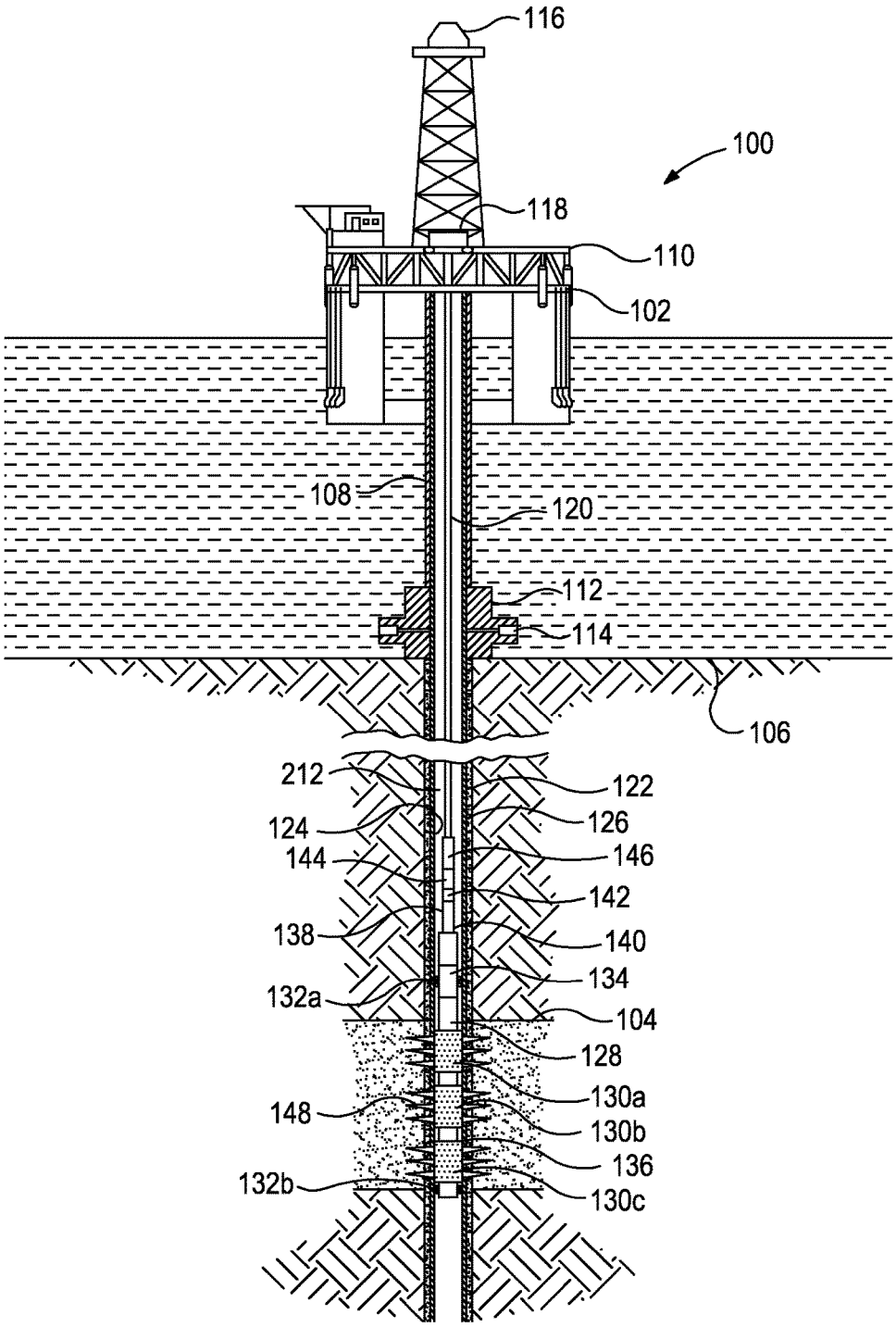
FIG. 1 is schematic diagram of a well system that can employ one or more principles of the present disclosure.

Referring FIG. 1, illustrated is an exemplary well system 100 that may employ one or more principles of the present disclosure, according to one or more embodiments. As illustrated, the well system 100 may include an offshore oil and gas platform 102 located above a submerged hydrocarbon-bearing formation 104 located below the sea floor 106. A subsea conduit or riser 108 extends from a deck 110 of the platform 102 to a wellhead installation 112 that may include one or more blowout preventers 114. The platform 102 may include a derrick 116 and a hoisting apparatus 118 for raising and lowering pipe strings, such as a work string 120. While the system 100 depicts the use of the offshore platform 102, it will be appreciated that the principles of the present disclosure are equally applicable to other types of oil and gas rigs or installation, such as land-based drilling and production rigs, service rigs, and other wellhead installations located at any geographical location.

A wellbore 122 extends from the wellhead installation 112 and through various earth strata, including the formation 104. Casing 124 may be cemented within at least a portion of the wellbore 122 using cement 126. A completion string 128 is depicted in FIG. 1 as being installed or positioned within the casing 124 and may include one or more sand control devices, such as sand screens 130*a*, 130*b*, and 130*c* positioned adjacent the formation 104 between packers 132*a* and 132*b*. A circulating valve 134 may be positioned above the upper packer 132*a*.

To prevent the production of sand or other particulate materials to the surface, the annulus 136 defined between the sand screens 130*a-c* and the walls of the wellbore 122 may be gravel packed. To gravel pack the annulus 136, the work string 120 may be lowered through the casing 124 and at least partially into the completion string 128. The work string 120 may include a service tool 138 having a shifting tool assembly 140, a reverse-out valve 142, a crossover tool 144, a setting tool 146, and other downhole tools known to those skilled in the art. Once the service tool 138 is properly positioned within completion string 128, the service tool 138 may be operated through various axial positions to gravel pack the annulus 136 and prepare the completion string 128 for production operations. As illustrated, portions of the casing 124 and the wellbore 122 have been perforated to provide one or more perforations 148 that extend a distance into the surrounding formation 104 and provide fluid conductivity between the formation 104 and the annulus 136.

Even though FIG. 1 depicts a vertical well, it will be appreciated by those skilled in the art that the principles of the present disclosure are equally well-suited for use in deviated wells, inclined wells, or horizontal wells. Also, even though FIG. 1 depicts a cased wellbore 122, the principles of the present disclosure are equally well-suited for use in open-hole completions. Additionally, even though FIG. 1 has been described with reference to a gravel packing operation, including a squeeze (i.e., hydraulic fracturing) operation, it should be noted that the principles of the present disclosure are equally well-suited for use in a variety of treatment operations where it is desirable to selectively allow and prevent circulation of fluids through the service tool 138.

The completion string 128 may include one or more downhole devices (not shown) used to seal various portions of the completion string 128. Each downhole device may include one or more primary sealing elements and, when placed downhole, the primary sealing elements prevent fluid migration across the given downhole device. Exemplary downhole devices that may be included in the completion string 128 include, but are not limited to, sleeves (e.g., fracture circulation sleeves, production sleeves, mid joint production sleeves, annular isolation sleeves, etc.), sliding sleeves (e.g., sliding side doors, hydraulic sliding side doors, gravel pack closing sleeves), ball valves (e.g., fluid saver, mechanical ball valve, etc.), flapper valves, and any combination thereof.

In some cases large pressure differentials may be generated across a given downhole device and its associated primary seals may be required to sustain the pressure differential while moving the given downhole device between closed and open positions. According to the present disclosure, and as described in more detail below, while the downhole device(s) are being moved between closed and open positions, the shifting tool assembly 140 may be configured to help equalize and otherwise withstand the pressure differential present across the given downhole device, and thereby mitigate potential damage that may be sustained by the primary seals. As a result, equalization of the pressure differential across the downhole device(s) may advantageously be facilitated and otherwise supported by the shifting tool assembly 140 instead of the given downhole device(s).

Figure 2:
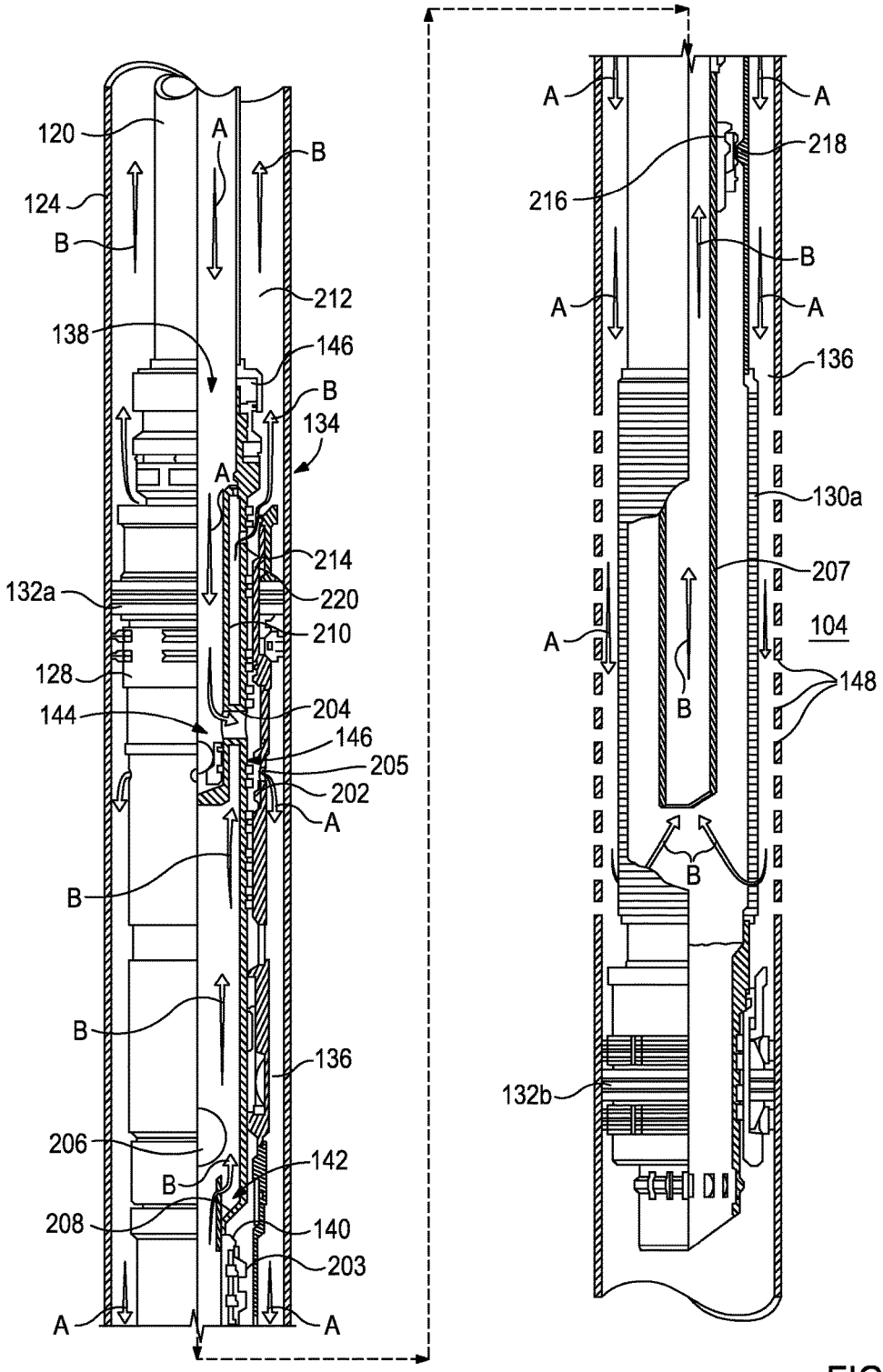
FIGS. 2-5 are progressive partial cross-sectional side views of an enlarged portion of the well system of FIG. 1.
Figure 3:
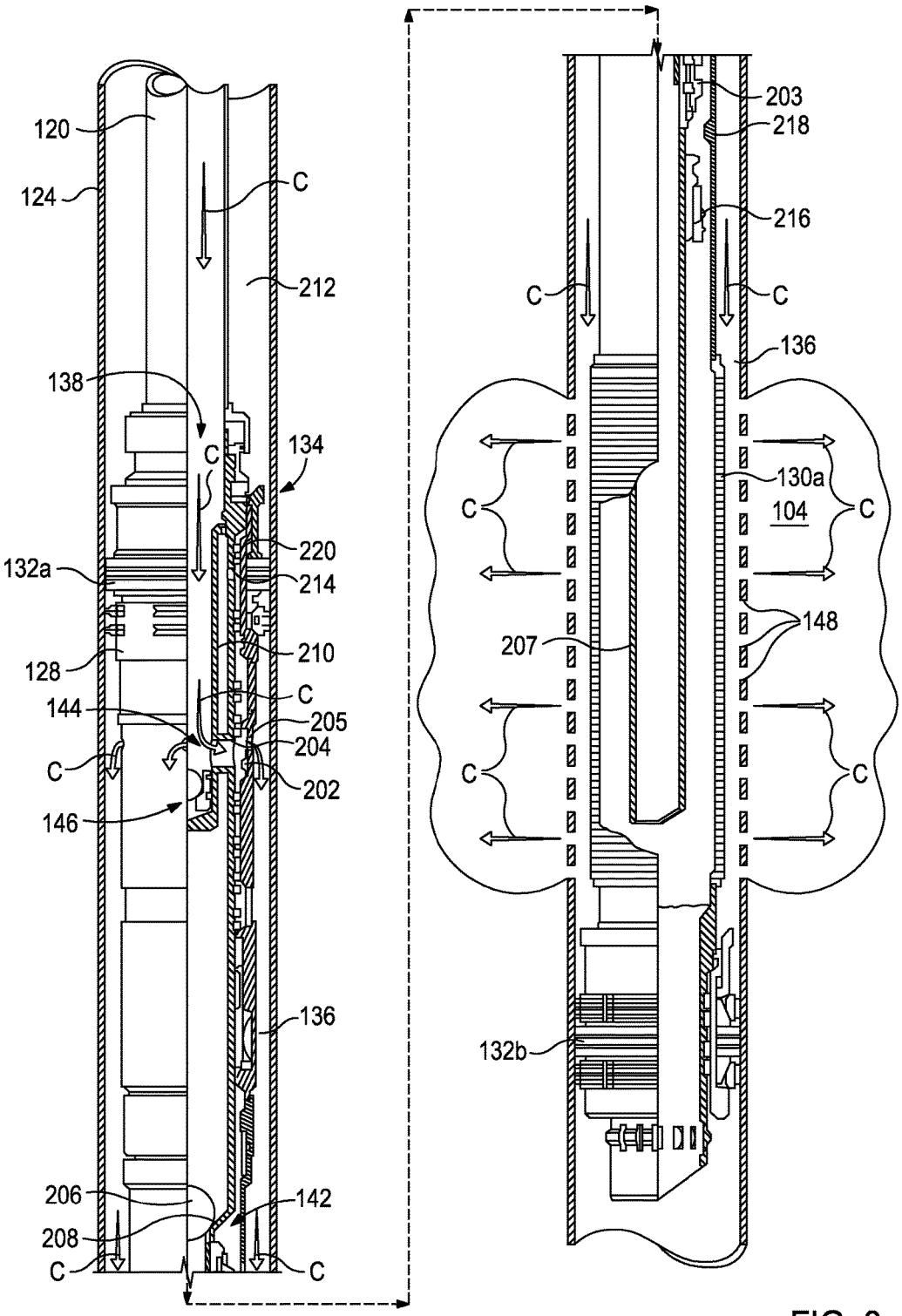
Figure 4:
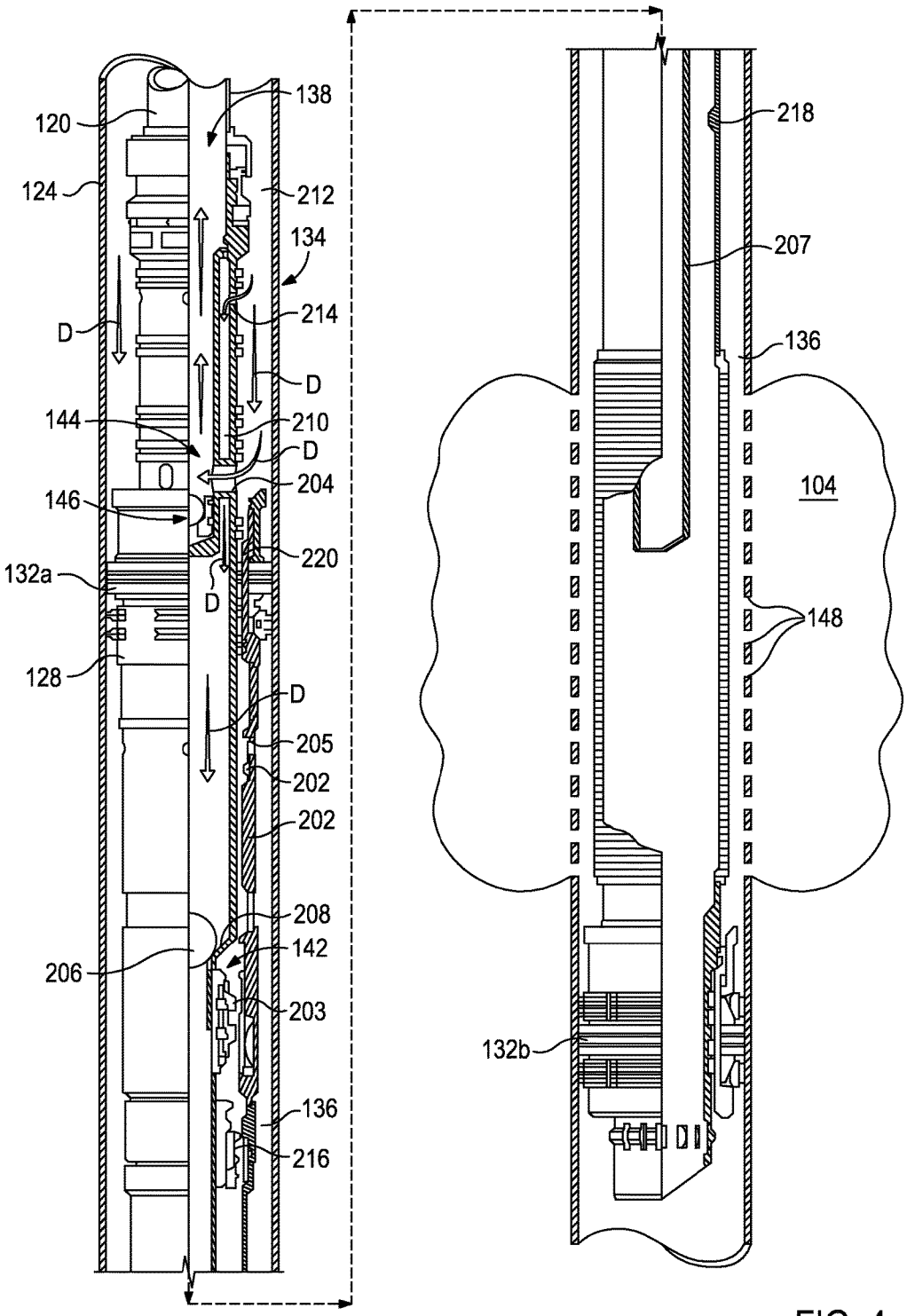
Figure 5:
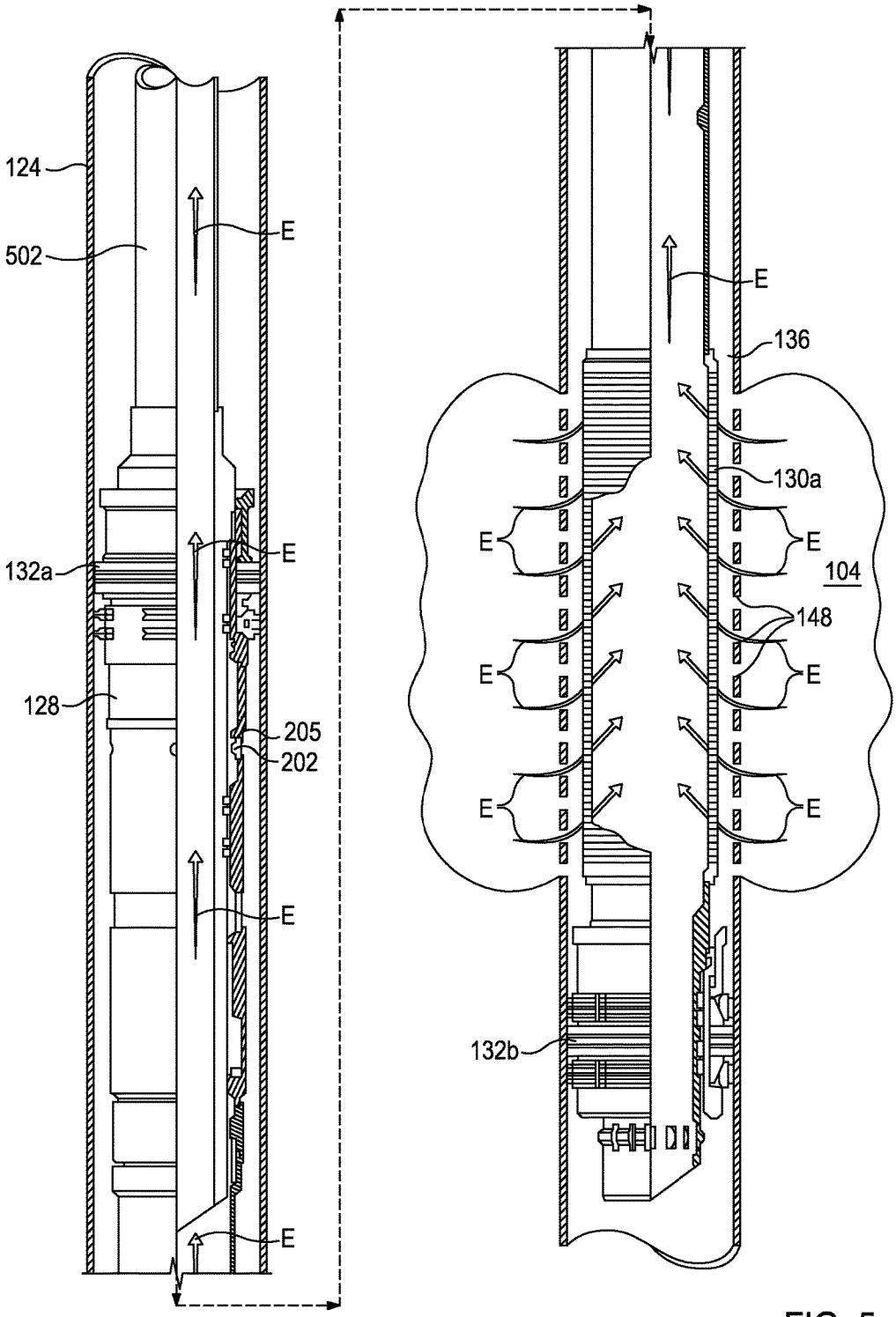

Referring now to FIGS. 2-5, with continued reference to FIG. 1, illustrated are partial cross-sectional side views of the service tool 138 positioned within the completion string 128, according to one or more embodiments. More particularly, FIGS. 2-5 depict successive axial sections of the service tool 138 and the completion string 128 while the service tool 138 is operated and otherwise axially manipulated relative to portions of the completion string 128 during a gravel-packing operation. In FIG. 2, the service tool 138 is depicted in a circulating position, in FIG. 3 the service tool 138 is depicted in a "squeeze" position, and in FIG. 4 the service tool 138 is depicted in a reverse-out position. FIG. 5 depicts hydrocarbon production following removal of the service tool 138. It is noted that only one sand screen 130*a* is depicted in FIGS. 2-5 for illustrative purposes. Those skilled in the art, however, will readily appreciate that more than one sand screen 130 (i.e., each of the sand screens 130*a-c* of FIG. 1) may be employed, without departing from the scope of the disclosure.

In FIG. 2, the service tool 138 is shown as having been inserted into the completion string 128, which includes one or more downhole devices, such as a sliding sleeve 202. As the service tool 138 enters the completion string 128, a shifting tool 203 associated with the shifting tool assembly 140 (FIG. 1) may engage and shift the sliding sleeve 202 from a closed position, where the sliding sleeve 202 occludes one or more flow ports 205 that communicate with the surrounding subterranean formation 104 (FIG. 1), to an open position, where the flow ports 205 are exposed, as illustrated. According to embodiments of the present disclosure, as the sliding sleeve 202 is moved to the open position, the shifting tool assembly 140 (and its associated shifting tool 203) help mitigate the effects of rapid pressure equalization across the sliding sleeve 202 as fluid pressure within the subterranean formation rushes into the completion string 128 seeking pressure equilibrium. As a result, the integrity of primary sealing elements (not shown) associated with the sliding sleeve 202 may be protected and otherwise preserved for future use.

As indicated by the arrows A, a fluid slurry including a liquid carrier and a particulate material such as sand, gravel and/or proppants is pumped down the work string 120 to the service tool 138 to undertake circulation operations. Once reaching the service tool 138, the fluid slurry traveling in the direction indicated by arrows A is able to exit the service tool 138 and enter the annulus 136 via the circulating valve 134 and, more particularly, via one or more circulation ports 204 provided by the crossover tool 144 and the flow ports 205 exposed by moving the sliding sleeve 202 to the open position. At least a portion of the gravel in the fluid slurry is deposited within the annulus 136 while some of the liquid carrier and proppants enter the surrounding formation 104 through the one or more perforations 148 formed in the casing 124 and extending into the formation.

The remainder of the fluid carrier re-enters the service tool 138 via the sand control screen 130*a*, as indicated by arrows B. The fluid carrier traveling in the direction indicated by arrows 13 then enters a wash pipe 207 and is conveyed upward towards the reverse-out valve 142, which may include a ball check 206 that, when the service tool 138 is in the circulating position, may be moved off a valve seat 208 such that the fluid carrier traveling in the direction indicated by arrows B may flow past and toward the crossover tool 144. At the crossover tool 144, the fluid carrier traveling in the direction indicated by arrows B may be conveyed to and through a return conduit 210 in fluid communication with an annulus 212 defined between the work string 120 and the wellbore 122 (FIG. 1) above the upper packer 132*a* via one or more return ports 214. After flowing out of the completion string 128 via the return ports 214, the fluid carrier traveling in the direction indicated by arrows B may return to the surface via the annulus 212. In the circulation position, the fluid slurry traveling in the direction indicated by arrows A is continuously pumped down the work string 120 until the annulus 136 around the sand control screen 130*a* is sufficiently filled with gravel, and the fluid carrier traveling in the direction indicated by arrows B is continuously returned to the surface via the annulus 212 for recycling.

In FIG. 3, the service tool 138 has been moved axially with respect to the completion string 128 to a "squeeze" position. This may be accomplished by disengaging a weight down collet 216 from an indicator collar 218 defined on the inner surface of the completion string 128 and thereafter axially moving the service tool 138 relative to the completion string 128 until a sleeve 220 of the completion string 128 occludes the return ports 214. In the illustrated embodiment, the service tool 138 has been moved axially downwards to place a seal 220 inside the upper packer 132*a* and thereby occlude the return ports 214.

Once the service tool 138 is properly placed in the squeeze position, additional fluid slurry or another treatment fluid may then be pumped down the work string 120 and to the service tool, as indicated by the arrows C. Once in the service tool 138, the fluid slurry traveling in the direction indicated by arrows C may again pass through the crossover tool 144 and the circulating valve 134 via the circulation ports 204 and finally into the annulus 136 where the fluid slurry traveling in the direction indicated by arrows C enters the perforations 148 to hydraulically fracture the formation 104. Since the return ports 214 are occluded by the seal 220 inside the packer mandrel, no return fluids enter the wash pipe 207 and flow towards the reverse-out valve 142. As a result, the ball check 206 is able to sit idly against the valve seat 208 under gravitational forces.

In FIG. 4, the service tool 138 has been moved into a reverse-out position to once again allow fluid returns to the surface. To accomplish this, the work string 120 and the service tool 138 are moved upwards with respect to the completion string 128, thereby exposing the return ports 214 and the circulation ports 204 to the annulus 212. In this configuration, a completion fluid may be pumped down the annulus 212 and into the service tool 138 through the crossover tool 144, as indicated by the arrows D. The completion fluid D flows into the work string 120 and returns to the surface via the work string 120 in order to reverse-out any gravel, proppant, or fluids that may remain within the work string 120.

During this process, a portion of the completion fluid D may also fluidly communicate with the reverse-out valve 142. More particularly, a portion of the completion fluid may enter the return conduit 210 via the return ports 214 and be conveyed toward the reverse-out valve 142 via the crossover tool 144. The fluid pressure exhibited by the completion fluid D forces the ball check 206 to seal against the valve seat 208, thereby creating a hard bottom that prevents the completion fluid D from traveling further downhole past the reverse-out valve 142.

In FIG. 5, the service tool 138 has been removed from the completion string 128 and returned to the surface. In its place, production tubing 502 has been stung into and otherwise operatively coupled to the completion string 128. At this point, hydrocarbons may be produced from the formation 104, through the sand screen 130*a*, and conveyed to the surface via the production tubing 502, as indicated by arrows E.

As the service tool 138 is pulled out of the completion string 128, the shifting tool 203 (FIGS. 2-4) may again engage and thereby close the sliding sleeve 202 to occlude the flow ports 205. Similar to when the sliding sleeve 202 is moved to the open position, the shifting tool assembly 140 (FIG. 1) and its associated shifting tool 203 may help equalize the pressure differential across the sliding sleeve 202 as it moves to the closed position. As a result, the integrity of the primary sealing elements (not shown) associated with the sliding sleeve 202 may again be protected and otherwise preserved for future use.

Figure 6A:
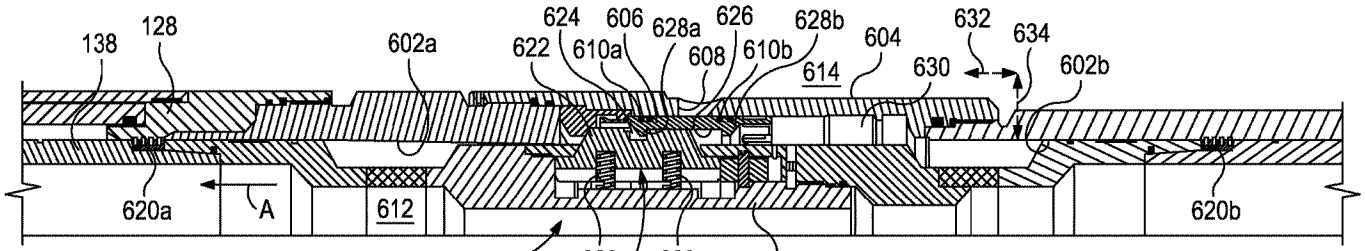
FIGS. 6A and 6B are partial cross-sectional side views of an exemplary embodiment of the shifting tool assembly of FIG. 1.
Figure 6B:
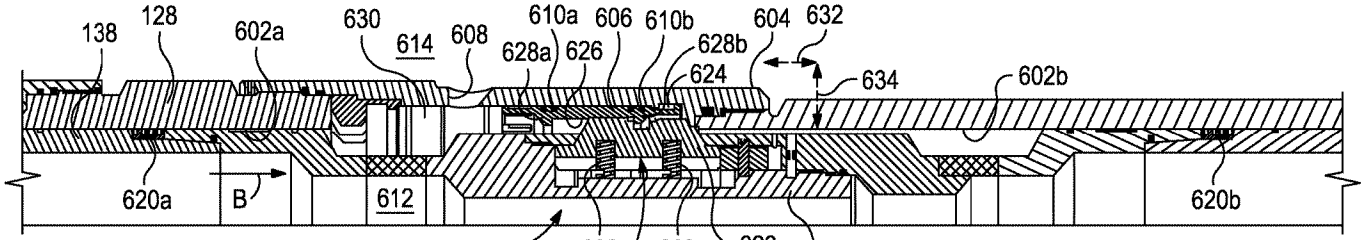

Referring now to FIGS. 6A and 6B, illustrated are cross-sectional side views of an exemplary embodiment of the shifting tool assembly 140, as first introduced with reference to FIG. 1. As illustrated in FIGS. 6A and 6B, the shifting tool assembly 140 is extended within the completion string 128 as coupled to the service tool 138. In some embodiments, the shifting tool assembly 140 may interpose upper and lower portions of the service tool 138. In other embodiments, however, the shifting tool assembly 140 may constitute the distal end of the service tool 138.

The completion string 128 may include several components or sections including, but not limited to, an upper seal bore 602*a*, a lower seal bore 602*b*, and a downhole device sub 604 that interposes or is at least located axially between the upper and lower seal bores 602*a,b*. In some embodiments, as discussed in more detail below, the lower seal bore 602*b* may be omitted from the completion string 128, without departing from the scope of the disclosure.

The downhole device sub 604 may be configured to receive and otherwise house a downhole device 606 used for operation in the completion string 128. The downhole device 606 may be any of the downhole devices mentioned or discussed above. In the illustrated embodiment, however, the downhole device 606 is depicted and described herein as a sliding sleeve, similar to the sliding sleeve 202 of FIGS. 2-4. Accordingly, the downhole device 606 will be referred to herein as "the sliding sleeve 606," but it will be appreciated that the sliding sleeve 606 may be replaced with any of the downhole devices mentioned herein, without departing from the scope of the disclosure.

The sliding sleeve 606 may be disposed within the downhole device sub 604 and movable between a closed position, where the sliding sleeve 606 occludes one or more flow ports 608 defined in the downhole device sub 604, and an open position, where the sliding sleeve 606 is axially moved within the downhole device sub 604 to expose the flow ports 608. In FIG. 6A, the sliding sleeve 606 is depicted in the closed position, while FIG. 6B depicts the sliding sleeve 606 in the open position.

The sliding sleeve 606 may include primary sealing elements 610 (shown as primary sealing elements 610*a* and 610*b*) positioned between the sliding sleeve 606 and an inner wall of the downhole device sub 604. In some embodiments, the primary sealing elements 610*a,b* may be arranged within corresponding grooves (not shown) defined on the outer surface of the sliding sleeve 606. When the sliding sleeve 606 is in the closed position, the primary sealing elements 610*a,b* may be positioned on either side of the flow ports 608 and thereby fluidly isolate an interior 612 of the completion string 128 from an exterior 614 of the completion string 128. In some embodiments, the exterior 614 may comprise the subterranean formation 104 of FIG. 1. Suitable materials for the primary sealing elements 610*a,b* include, but are not limited to, elastomers, non-elastomeric materials, metals, composites, rubbers, ceramics, derivatives thereof, and any combination thereof. In some embodiments, one or more of the primary sealing elements 610*a,b* may be an elastomeric O-ring or the like.

In the depicted embodiment, the shifting tool assembly 140 may include an elongate mandrel 616, a shifting tool 618, one or more upper equalization seals 620*a*, and one or more lower equalization seals 620*b*. As illustrated, the mandrel 616 may comprise two or more structural components, but may alternatively comprise an elongate, monolithic structure. The shifting tool 618 may be similar to or the same as the shifting tool 203 of FIGS. 2-4. The shifting tool 618 may be operably coupled to the mandrel 616 and spring-loaded for radial movement relative thereto. More particularly, the shifting tool 618 may include one or more keys 622 that are biased away from the mandrel 616 with one or more springs 623 (two shown) or other types of radial biasing devices.

Each key 622 may provide or otherwise have a shifter profile 624 defined on its outer radial surface, and the shifter profile 624 may be configured to locate and engage a corresponding sleeve profile 626 defined on the inner radial surface of the sliding sleeve 606. In some embodiments, as illustrated, the sleeve profile 626 may have an upper detent 628*a* and a lower detent 628*b*, each extending radially inward from the sliding sleeve 606. The shifter profile 624 may be configured to locate and engage the upper and lower detents 628*a,b* in order to move the sliding sleeve 606 between the upper and lower positions. For instance, to move the sliding sleeve 606 to the closed position, as shown in FIG. 6A, the shifter profile 624 may be configured to locate and engage the upper detent 628*a* and thereafter pull the sliding sleeve 606 in an uphole direction, as indicated by the arrow A (i.e., to the left in FIGS. 6A and 6B). Conversely, to move the sliding sleeve 606 to the open position, as shown in FIG. 6B, the shifter profile 624 may be configured to locate and engage the lower detent 628*b* and thereafter push the sliding sleeve 606 in a downhole direction, as indicated by the arrow B in FIG. 6B (i.e., to the right in FIGS. 6A and 6B).

In either of the embodiments of FIG. 6A or 6B in closing or opening the sliding sleeve 606, the service tool 138 may be moved within the completion string 128 using a downhole tractor (not shown) or the like. As will be appreciated, using a downhole tractor may prove advantageous in providing controlled movement through the completion string 128 in either the uphole A or downhole B directions. The downhole tractor may be configured to pull or push the service tool 138, without departing from the scope of the disclosure.

As illustrated, the upper equalization seals 620*a* are arranged uphole from the shifting tool 618 while the lower equalization seals 620*b* are arranged downhole from the shifting tool 618. While only one set of upper equalization seals 620*a* and one set of lower equalization seals 620*b* are depicted in FIGS. 6A and 6B, it will be appreciated that two or more sets of upper and/or lower equalization seals 620*a,b* may be employed, without departing from the scope of the disclosure. In some embodiments, the upper and lower equalization seals 620*a,b* may be characterized as dynamic seals. As used herein, the term "dynamic seal" refers to a seal that provides pressure and/or fluid isolation between members that have relative displacement therebetween, for example, a seal that seals against a displacing surface, or a seal carried on one member that seals against another member. Suitable materials for the upper and lower equalization seals 620*a,b* include, but are not limited to, elastomers, a non-elastomeric material, metals, composites, rubbers, ceramics, derivatives thereof, and any combination thereof. In some embodiments, the upper and lower equalization seals 620*a,b* may be an O-ring or the like. In other embodiments, however, the upper and lower equalization seals 620*a,b* may be sets of v-rings or CHEVRON® packing rings, or other appropriate seal configurations (e.g., seals that are round, v-shaped, u-shaped, square, oval, t-shaped, etc.), as generally known to those skilled in the art, or any combination thereof.

In at least one embodiment, the upper and lower equalization seals 620*a,b* may be axially spaced from each other along the mandrel 616 such that each is able to simultaneously seal against the upper and lower seal bores 602*a,b*, respectively, as the shifting tool 618 engages and shifts the sliding sleeve 606 between the open and closed positions. As a result, the upper and lower equalization seals 620*a,b* may be configured to assume the high pressure fluid equalization forces as the sliding sleeve 606 is moved between the open and closed positions and high pressure fluid flow seeks pressure equilibrium. As generally described above, such high pressure fluid equalization forces may otherwise damage the primary seals 610*a,b*.

Exemplary operation of the shifting tool assembly 140 in closing the sliding sleeve 606 is now provided with reference to FIG. 6A. In FIG. 6A, the shifting tool assembly 140 is being pulled upwards in the uphole direction A relative to the completion string 128. Prior to moving the sliding sleeve 606 to the closed position, the flow ports 608 may be exposed and fluids may be flowing either into or out of the completion string 128 at a relatively high flow rate. In some embodiments, for example, fluids may be flowing into the interior 612 of the completion string 128 at a relatively high flow rate from the exterior 614, such as in the case of production operations. In other embodiments, however, fluids may be flowing from the completion string 128 or the service tool 138 and to the exterior 614 via the flow ports 608, such as in the case of injection operations.

As the shifting tool assembly 140 is pulled uphole A, the upper and lower equalization seals 620*a,b* may eventually come into contact with and seal against the upper and lower seal bores 602*a,b* of the completion string 128. With the upper and lower equalization seals 620*a,b* sealed against the upper and lower seal bores 602*a,b*, respectively, a differentially isolated chamber 630 may be defined between the upper and lower equalization seals 620*a,b* and the completion string 128. At this point, the upper and lower equalization seals 620*a,b* may then assume the high pressure fluid flow circulating through the flow ports 608 and thereby cease or substantially cease flow through the flow ports 608.

Continued movement of the shifting tool assembly 140 in the uphole direction A may allow the shifting tool 618 to locate and engage the sliding sleeve 606 while the upper and lower equalization seals 620*a,b* dynamically seal against the upper and lower seal bores 602*a,b*, respectively. More particularly, the shifter profile 624 defined on the keys 622 may locate and engage the upper detent 628*a* of the sleeve profile 626 and continued movement of the shifting tool assembly 140 in the uphole direction A may move the sliding sleeve 606 to the closed position where the flow ports 608 are occluded. With the sliding sleeve 606 in the closed position, as depicted in FIG. 6A, the differentially isolated chamber 630 may be isolated from the exterior 614 and generally isolated from the portions of the interior 612 of the completion string 128 outside of the differentially isolated chamber 630. As a result, a pressure differential may be generated across the shifting tool assembly 140 between the exterior 614 and the interior 612 of the completion string 128.

With the upper and lower equalization seals 620*a,b* dynamically sealing against the upper and lower seal bores 602*a,b*, the sliding sleeve 606 may be allowed to move to the closed position within the generated differentially isolated chamber 630 where fluids have ceased flowing. As a result, the primary seals 610*a,b* of the sliding sleeve 606 may not be required to assume rapid pressure equalization forces that would otherwise occur by closing the sliding sleeve 606 while high pressure fluids flow through the flow ports 608. Accordingly, the primary seals 610*a,b* may be protected from pressure equalization damage and, instead, any seal damage resulting from rapid pressure equalization may be assumed by the upper and lower equalization seals 620*a,b*.

As the shifting tool assembly 140 continues moving in the uphole direction A, the keys 622 may eventually engage a reduced diameter portion (e.g., an upper end wall) of the completion string 128, which may force the keys 622 to radially retract against the spring force of the springs 623. Radially retracting the keys 622 may allow the keys 622 to disengage from the upper detent 628*a* and thereby effectively disengage the shifting tool 618 from the sliding sleeve 606. Moreover, retracting the keys 622 may allow the shifting tool 618 to be able to fit within the upper seal bore 602*a*. As the shifting tool assembly 140 continues moving in the uphole direction A, the upper and lower equalization seals 620*a,b* will eventually move out of sealing engagement with the upper and lower seal bores 602*a,b*, respectively, which will transfer the pressure differential assumed by the upper and lower equalization seals 620*a,b* to the sliding sleeve 606 and its primary seals 610*a,b*. In the event the upper and lower equalization seals 620*a,b* sustained any damage by assuming the rapid pressure equalization forces while closing the sliding sleeve 606, the service tool 138 may be retrieved to surface where the upper and lower equalization seals 620*a,b* may be redressed, rehabilitated, or replaced, if necessary.

Exemplary operation of the shifting tool assembly 140 in opening the sliding sleeve 606 is now provided with reference to FIG. 6B. In FIG. 6B, the shifting tool assembly 140 is being conveyed into the completion string 128 in a downhole direction relative to the completion string 128, as indicated by the arrow B. Prior to moving the sliding sleeve 606 to the open position, as shown in FIG. 6B, fluids may be prevented from flowing either into or out of the completion string 128 via the flow ports 608. Moving the sliding sleeve 606 to the open position, however, may initiate fluid communication between the exterior 614 (e.g., the formation 104 of FIG. 1) and the interior of the completion string 128 at a relatively high flow rate via the flow ports 608, such as in the case of production operations. Accordingly, a pressure differential may be generated across the sliding sleeve 606, where the sliding sleeve 606 prevents high pressure fluids in the exterior 614 from entering the completion string 128 via the flow ports 608.

As the shifting tool assembly 140 is moved downhole B, the upper and lower equalization seals 620*a,b* may eventually come into contact with and sealingly engage the upper and lower seal bores 602*a,b*, respectively, and thereby generate the differentially isolated chamber 630, as generally described above. Further movement of the shifting tool assembly 140 in the downhole direction B may allow the shifting tool 618 to locate and engage the sliding sleeve 606 while the upper and lower equalization seals 620*a,b* each dynamically seal against the upper and lower seal bores 602*a,b*, respectively. More particularly, the shifter profile 624 may locate and engage the lower detent 628*b* of the sleeve profile 626, and continued movement of the shifting tool assembly 140 in the downhole direction B may serve to move the sliding sleeve 606 to the open position, and thereby expose the flow ports 608 to the differentially isolated chamber 630.

With the upper and lower equalization seals 620*a,b* dynamically sealing against the upper and lower seal bores 602*a,b*, the sliding sleeve 606 may be allowed to move to the open position within the generated differentially isolated chamber 630 where fluids have ceased flowing. As the shifting tool assembly 140 continues moving in the downhole direction B, the keys 622 may engage a reduced diameter portion (e.g., a lower end wall) of the completion string 128, which may force the keys 622 to radially retract against the spring force of the springs 623. Radially retracting the keys 622 may disengage the keys 622 from the lower detent 628*b* and thereby effectively disengage the shifting tool 618 from the sliding sleeve 606. Moreover, retracting the keys 622 may allow the shifting tool 618 to be able to fit within the lower seal bore 602*b*.

As the shifting tool assembly 140 continues moving in the downhole direction B, the upper and lower equalization seals 620*a,b* will eventually move out of sealing engagement with the upper and lower seal bores 602*a,b*, respectively. By that time, the sliding sleeve 606 will already be in the open position and the upper and lower equalization seals 620*a,b* may be configured to assume the rapid pressure equalization forces generated by the high pressure fluids from the exterior 614 attempting to rush into the completion string 128 via the exposed flow ports 608. As a result, the primary seals 610*a,b* of the sliding sleeve 606 may be protected from damage resulting from rapid pressure equalization that would otherwise occur by opening the sliding sleeve 606 with an elevated flow rate of fluids flowing through the flow ports 608. Instead, any seal damage resulting from rapid pressure equalization may be assumed by the upper and lower equalization seals 620*a,b*. In the event the upper and lower equalization seals 620*a,b* sustained any damage by assuming the elevated pressure in opening the sliding sleeve 606, the service tool 138 may be retrieved to surface where the upper and lower equalization seals 620*a,b* may be redressed, rehabilitated, or replaced, if necessary.

Referring again to both FIGS. 6A and 6B, in some embodiments, the upper and lower equalization seals 620*a,b* may be staggered such that the differentially isolated chamber 630 may be sealed at its bottom end by the lower equalization seals 620*a*, but open at its upper end while moving the shifting tool assembly 140 in the uphole A or downhole B directions. In such embodiments, the differentially isolated chamber 630 may be filled at least partially with a fluid 632 at well pressure. In some embodiments, the fluid 632 may be injected into the differentially isolated chamber 630 at an injection port 634 in fluid communication with the differentially isolated chamber 630 and a reservoir (not shown) of the fluid 632). In other embodiments, the fluid 632 may be pumped into the differentially isolated chamber 630 via the service tool 138 and otherwise within the interior 612 of the completion string 128. As will be appreciated, filling the differentially isolated chamber 630 at least partially with the fluid 632 at well pressure may minimize the volume of fluid required to equalize across the sliding sleeve 606 as it is closed or opened. In any of the embodiments described herein, the fluid 630 and the fluids flowing through the completion string 128 and/or the service tool 128 may be a gas, a liquid, or a combination of a gas and a liquid.

It will be appreciated that, in some embodiments, the shifting tool assembly 140 may be manipulated and otherwise moved so as to partially open and/or partially close the sliding sleeve 606. In such embodiments, the movement of the shifting tool assembly 140 may be reversed so as to either fully re-close or fully re-open the sliding sleeve 606 after only partially opening or partially closing the sliding sleeve 606.

Figure 7:
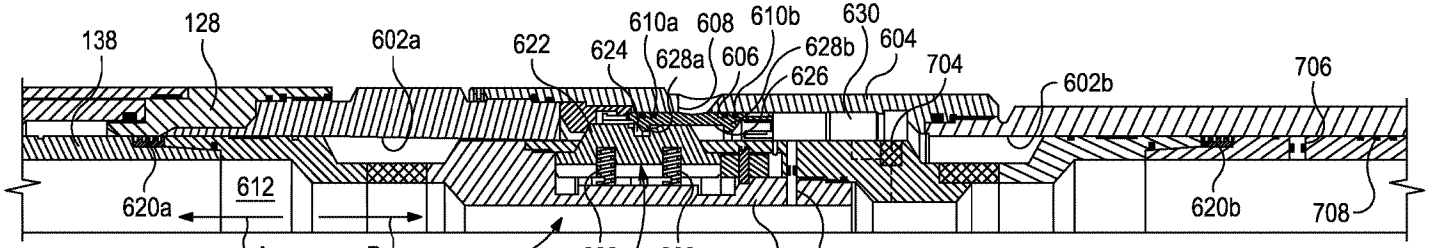
FIG. 7 is a partial cross-sectional side view of another exemplary embodiment of the shifting tool assembly of FIG. 1.

Referring now to FIG. 7, illustrated is a cross-sectional side view of another exemplary embodiment of the shifting tool assembly 140, according to one or more embodiments. The shifting tool assembly 140 of FIG. 7 may be similar in some respects to the shifting tool assembly 140 of FIGS. 6A and 6B and therefore may be best understood with reference thereto, where like numerals represent like elements not described again. The shifting tool assembly 140 of FIG. 7, however, may include at least one choke that enables a small amount of fluid flow while the sliding sleeve 606 is being moved between the open and closed positions. The fluid flow allowed by the choke may be a predetermined amount of flow configured to protect the primary seals 610*a,b* from damage.

In one embodiment, for example, the shifting tool assembly 140 may include a first choke 702 positioned on or through the mandrel 616 and arranged axially between the upper and lower equalization seals 620*a,b*. The first choke 702 may provide a metered amount (e.g., a limited volumetric rate in GPM) of fluid communication between the differentially isolated chamber 630 and the interior 612 of the completion string 128 as the shifting tool 618 moves the sliding sleeve 606 between the open and closed positions. In some embodiments, the first choke 702 may be a choke bean, which may comprise a hardened insert that has a restricted inner diameter configured to restrict flow. The use of a choke bean, however, may equally include the use of other devices, such as pressure regulators, inflow control devices, and tube-type flow restrictors. By allowing a metered amount of fluid flow through the first choke 702, hydraulic lock of the service tool 138 may be prevented. This may prove especially advantageous in embodiments where the upper and lower equalization seals 620*a,b* are of differing sizes and, therefore a differential piston pressure may be generated between the upper and lower equalization seals 620*a,b*.

In other embodiments, the first choke 702 may be used to help equalize the pressure between the exterior 614 of the completion string 128 and the interior 612. More specifically, in at least one embodiment, movement of the shifting tool assembly 140 may be stopped at a point when the upper and lower equalizing seals 620*a,b* seal against the upper and lower seal bores 602*a,b*, respectively, thereby generating a pressure differential across the shifting tool assembly 140. In such embodiments, the shifting tool assembly 140 may be moved in the uphole A or downhole B directions to either open or close the sliding sleeve 606. Stopping movement of the shifting tool assembly 140 at this point may allow the first choke 702 to gradually dissipate or bleed off the pressure differential assumed across the shifting tool assembly 140. The first choke 702 may be made of a hardened material, such as carbide, or may have a carbide insert (not shown) that resists erosion from any fluid flow passing therethrough.

In some embodiments, the shifting tool assembly 140 may be stopped for a predetermined period of time to allow the first choke 702 to alleviate or reduce the pressure differential. In other embodiments, the shifting tool assembly 140 may further include a pressure monitoring device 704 that may be ported to the differentially isolated chamber 630 and the interior 612 of the completion string 128. In some embodiments, the pressure monitoring device may be an electrical pressure regulator. The pressure monitoring device 704 may also be used to measure the pressure differential as the first choke 702 dissipates the fluid pressure across the shifting tool assembly 140. Once a predetermined pressure differential is reached, or the pressure differential is substantially removed, the pressure monitoring device 704 may be configured to communicate a signal (wired or wireless) to a surface location (e.g., a well operator on the platform 102 of FIG. 1) reporting the same. Upon receipt of the signal from the pressure monitoring device 704, a decision could be made to fully retrieve the service tool 138 or convey it further past the sliding sleeve 606 without risking damage to the primary seals 610*a,b* of the sliding sleeve 606.

In another embodiment, the shifting tool assembly 140 may include a second choke 706 positioned on or through the mandrel 616 and arranged axially between adjacent sets of upper/lower equalization seals. In the illustrated embodiment, the second choke 706 is depicted as being positioned axially between the first set of lower equalization seals 620*b* and a second set of lower equalization seals 708, where the second set of lower equalization seals 708 are axially spaced downhole from the first set of lower equalization seals 620*b*. While described herein in conjunction with axially adjacent lower equalization seals, the second choke 706 may equally be included or otherwise employed in conjunction with axially adjacent upper equalization seals, without departing from the scope of the disclosure.

Similar to the first set of lower equalization seals 620*b*, the second set of lower equalization seals 708 may be configured to sealingly engage the lower seal bore 602*b* as the shifting tool assembly 140 passes by the sliding sleeve 606. Moreover, similar to the first choke 702, the second choke 706 may comprise or otherwise include a choke bean, or any of the devices equivalent to a choke bean mentioned above, and may be made of a hardened material, such as carbide, or may have a carbide insert (not shown) that resists erosion from any fluid flow passing therethrough.

In exemplary operation, the second choke 706 may prove advantageous in bleeding off pressure prior to removing the service tool 138 from the completion string 128. More particularly, as the shifting tool assembly 140 is moved in the uphole direction A, the first set of lower equalization seals 620*b* will eventually move out of engagement with the lower seal bore 602*b* and into the differentially isolated chamber 630. In such cases, the pressure differential assumed across the shifting tool assembly 140 may then be at least partially maintained with the second set of lower equalization seals 708 as sealingly engaged with the lower seal bore 602*b*. The second choke 706 may operate to gradually dissipate or bleed off the pressure differential across the shifting tool assembly 140 while the second set of lower equalization seals 708 remains in sealed engagement with the lower seal bore 602*b*. In some embodiments, a well operator may desire to stop movement of the shifting tool assembly 140 at this point for a predetermined period of time to allow the second choke 706 to reduce or otherwise eliminate the pressure differential. Reducing or eliminating the pressure differential may prove advantageous while removing the service tool 138 from the completion string 128 in avoiding rapid depressurization, which could occur once the upper and lower equalization seals 620*a,b* are both removed from engagement with the upper and lower seal bores 602*a,b*. If the pressure differential is not reduced or removed, the rapid depressurization could cause damage to various downhole equipment. For instance, rapid depressurization of the upper and lower equalization seals 620*a,b* could result explosive decompression of the upper and lower equalization seals 620*a,b*. It will be appreciated that similar advantages may be gained while moving the service tool 138 in the downhole direction B, without departing from the scope of the disclosure.

Figure 8A:
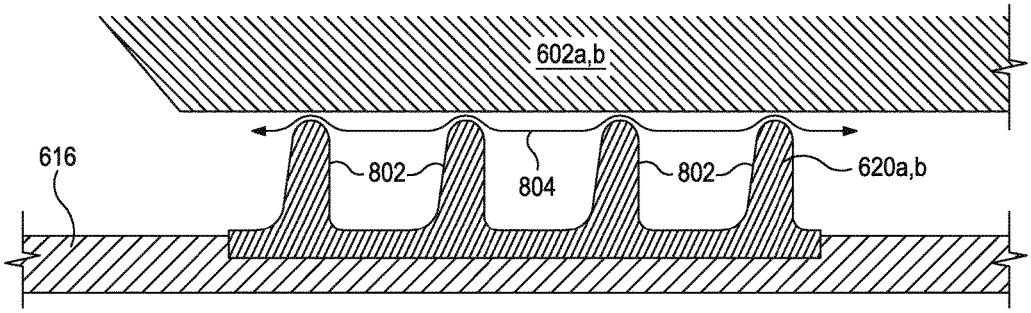
FIGS. 8A-8C are partial cross-sectional side views of exemplary upper and lower equalization seals.
Figure 8B:
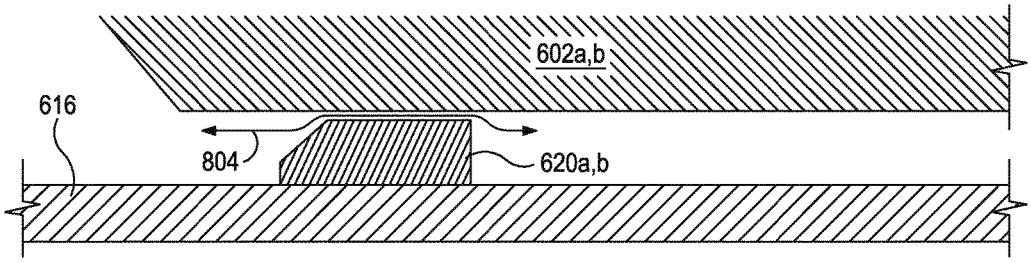
Figure 8C:
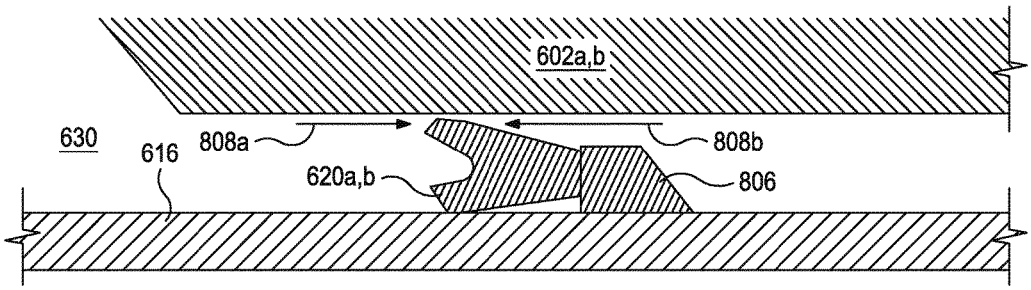

Referring now to FIGS. 8A-8C, illustrated are cross-sectional side views of exemplary upper and lower equalization seals 620*a,b*, according to one or more embodiments. The embodiments shown in FIGS. 8A-8C may be representative of one or both of the upper and lower equalization seals 620*a,b*. Accordingly, FIGS. 8A-8C depict the upper and lower equalization seals 620*a,b* as being positioned on the mandrel 616 and sealingly engaging the upper and lower seal bores 602*a,b*.

In some embodiments, as shown in FIG. 8A, one or both of the upper and lower equalization seals 620*a,b* may be a baffle seal that provides a plurality of seal cups 802 that extend radially to engage the upper and lower seal bores 602*a,b*. Baffle seals may prove advantageous in allowing the upper and lower equalization seals 620*a,b* to seal against a broad range of sizes for the seal bores 602*a,b*. As will be appreciated, however, baffle seals typically exhibit less sealing integrity than other types of seals. As a result, a small amount of fluid may be able to bypass the baffle seal in either axial direction 804. As will be appreciated, allowing a small amount of fluid to migrate across the baffle seals may prove advantageous in being able to choke or meter a small amount of fluid across the upper and lower equalization seals 620*a,b*, similar to operation of the first and second chokes 702, 706 of FIG. 7. Such fluid migration may further help prevent hydraulic lock as the shifting tool assembly 140 (FIGS. 6A, 6*b*, and 7) moves relative to the completion assembly 128 (FIGS. 6A, 6*b*, and 7).

In other embodiments, as shown in FIG. 8B, one or both of the upper and lower equalization seals 620*a,b* may be a seal ring disposed about the mandrel 616 and configured to provide a tight fitting ring against the upper and lower seal bores 602*a,b*. The seal ring may be made of a variety of materials including, but not limited to, metal, plastic, elastomers, hardened rubber, any derivative thereof, and any combination thereof. Similar to the baffle seal of FIG. 8A, the seal ring may be configured to provide a substantial seal or choking effect against the upper and lower seal bores 602*a,b*, but may also allow a small amount of fluid migration in either axial direction 804.

In yet other embodiments, as shown in FIG. 8C, one or both of the upper and lower equalization seals 620*a,b* may be a one-way seal disposed axially against a radial shoulder 806. The one-way seal may prove advantageous in preventing or substantially preventing fluid migration in a first direction 808*a*, while allowing a small or metered amount (e.g., a limited volumetric rate in GPM) of fluid migration to bypass the one-way seal in a second direction 808*b* opposite the first direction 808*a*. The one-way seal may prove advantageous in embodiments where it is desired to pressurize an area adjacent a downhole device, such as the differentially isolated chamber 630 adjacent the sliding sleeve 606 of FIGS. 6A-6B and 7. In such embodiments, the one-way seal may be positioned within the corresponding upper or lower seal bores 602*a,b* and a fluid may be injected into the differentially isolated chamber 630 in the second direction 808*b* across the one-way seal. The fluid may be injected into the differentially isolated chamber 630 until achieving a desired pressure differential between the differentially isolated chamber 630 and the exterior 614 (FIGS. 6A-6B and 7) of the completion string 128 (FIGS. 6A-6B and 7). In some embodiments, as described above, it may be desired to pressurize the differentially isolated chamber 630 to eliminate the pressure differential, and thereby allowing the sliding sleeve 606 to be opened with equalization pressure on either side of the primary seals 610*a,b* (FIGS. 6A-6B and 7). As a result, the primary seals 610*a,b* will not assume rapid pressure equalization forces while opening the sliding sleeve 606.

Figure 9A:
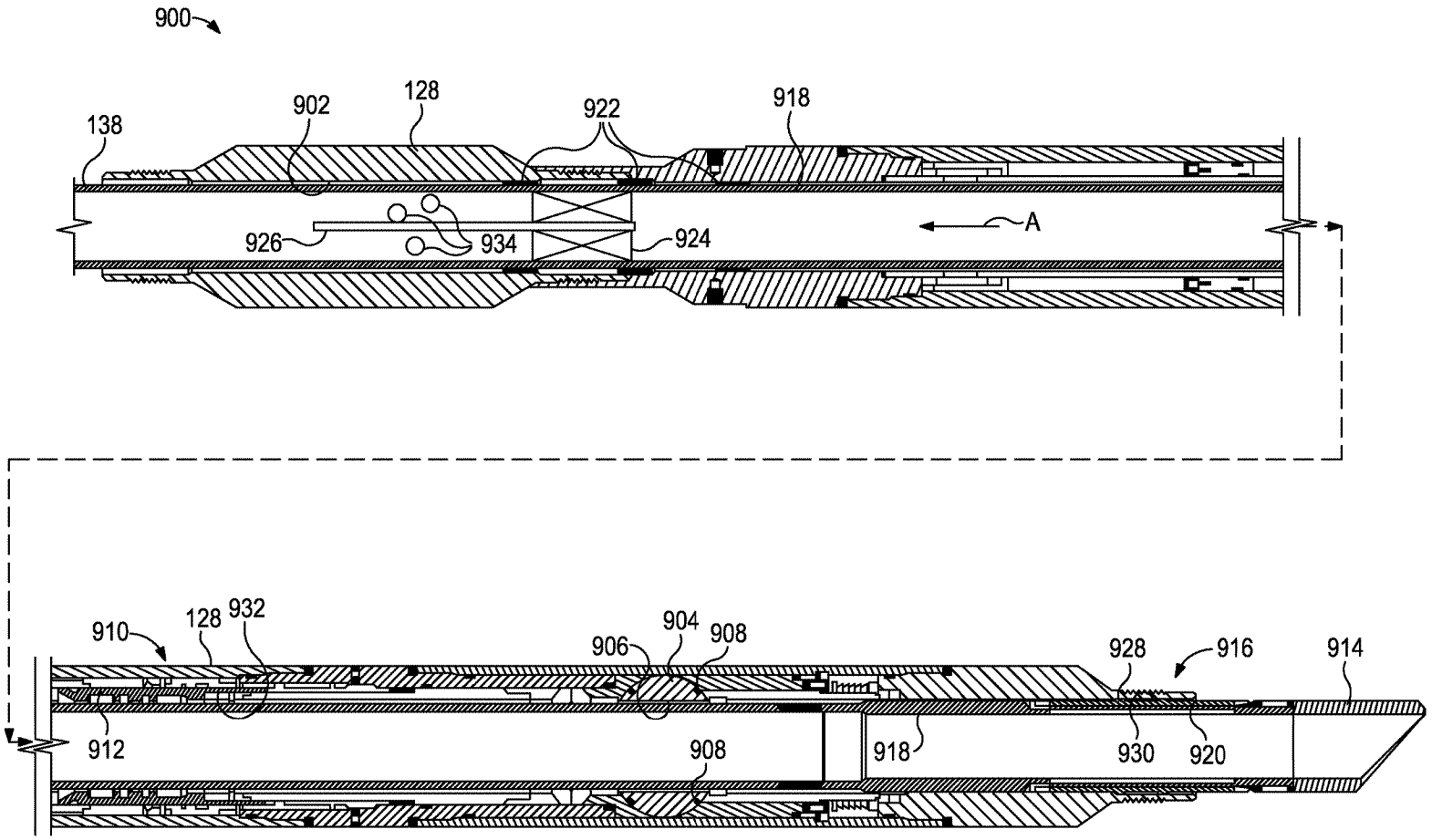
FIGS. 9A-9C are progressive cross-sectional side views of an exemplary downhole system that utilizes a ball valve downhole device.
Figure 9B:
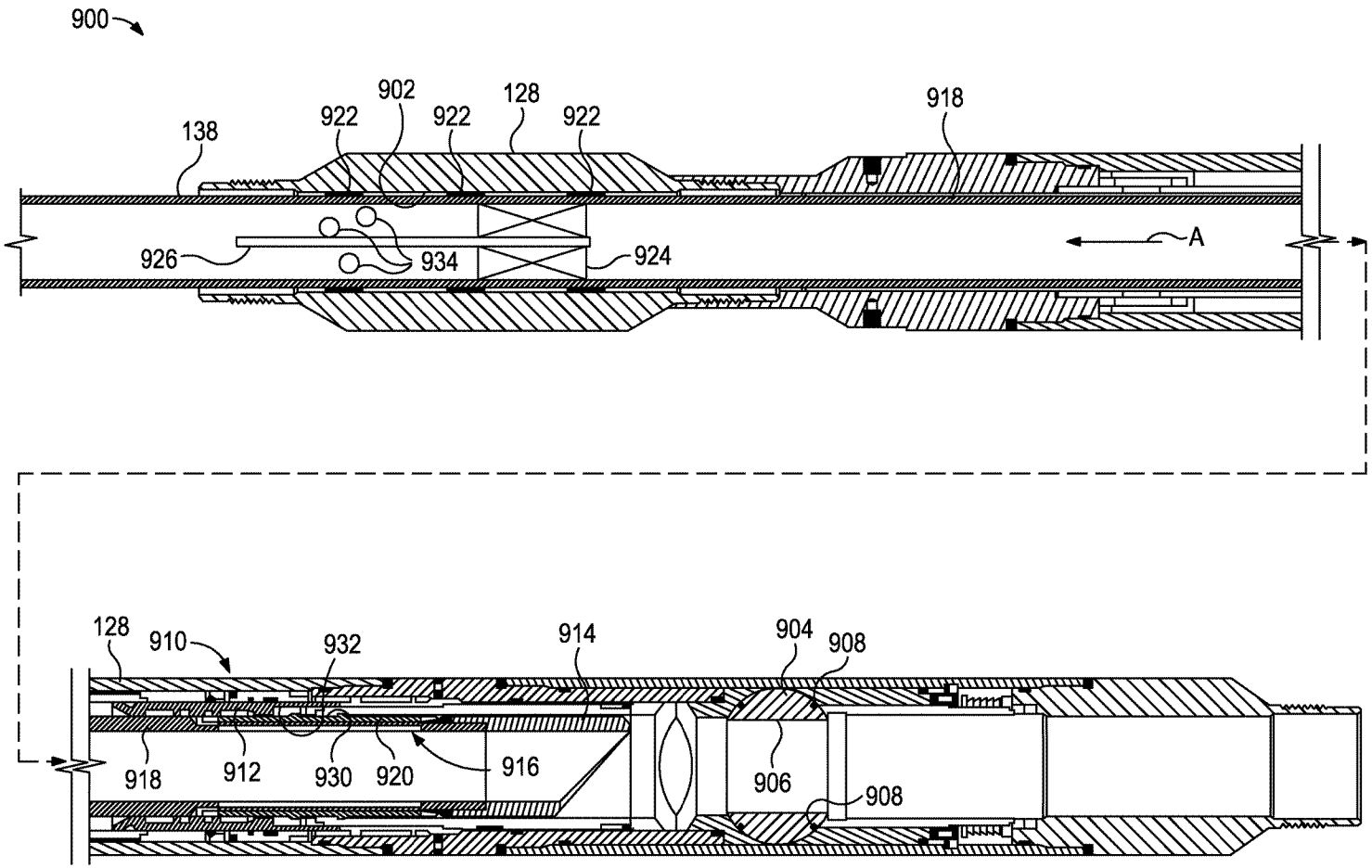
Figure 9C:
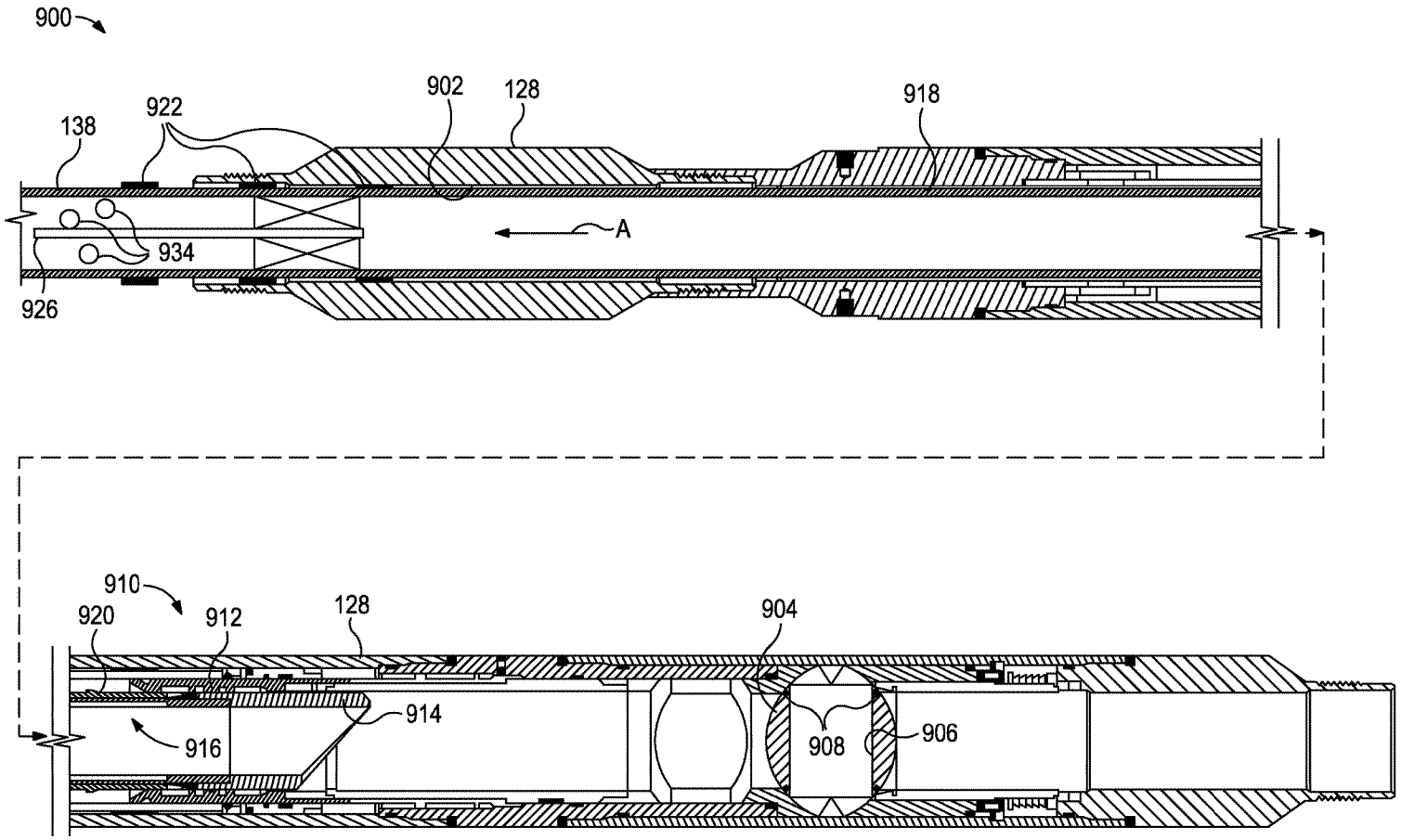

Referring now to FIGS. 9A-9C, illustrated are cross-sectional side views of an exemplary downhole system 900, according to one or more embodiments. As illustrated, the downhole system 900 may include the completion string 128 and the service tool 138 extended into the completion string 128. FIGS. 9A-9C depict progressive views of the service tool 138 as it is retracted out of the completion string 128 in the uphole direction A. The completion string 128 may include several components or sections including, but not limited to, an upper seal bore 902 and a downhole device 904 positioned axially downhole from the upper seal bore 902. The downhole device 904 may be any of the downhole devices mentioned or discussed above. In the illustrated embodiment, however, the downhole device 904 is depicted and described herein as a ball valve. Accordingly, the downhole device 904 will be referred to herein as "the ball valve 904," but it will be appreciated that the ball valve 904 may be replaced with any of the downhole devices mentioned herein, without departing from the scope of the disclosure.

The ball valve 904 may be movable or otherwise rotatable between an open position, where a central conduit 906 defined through the ball valve 904 aligns with the longitudinal axis of the completion string 128, and a closed position, where the central conduit 906 is misaligned with the longitudinal axis. In FIGS. 9A and 9B, the ball valve 904 is depicted in the open position and thereby able to receive the service tool 138 therethrough. In FIG. 9C, the ball valve 904 is depicted in the closed position. The ball valve 904 may include primary seals 908 configured to seal against corresponding surfaces of the completion string 128 when the ball valve 904 is in the closed position. Suitable materials for the primary seals 908 include, but are not limited to, elastomers and rubbers. In some embodiments, the primary seals 908 may be elastomeric O-rings or the like. The primary seals 908 may be configured to provide a sealed interface when the ball valve 904 is in the closed position such that fluid migration past the ball valve 904 within the completion string 128 is prevented or substantially prevented.

The ball valve 904 may be moved between the open and closed positions through operation of a ball valve actuation system 910. The ball valve actuation system 910 may include a sliding sleeve 912 that is operatively coupled to the ball valve 904 such that movement of the sliding sleeve 912 within the completion string 128 correspondingly moves the ball valve 904 between the open and closed positions. In some embodiments, for example, a mechanical coupling, mechanism, or linkage may operatively couple the sliding sleeve 912 and the ball valve 904 such that physical movement of the sliding sleeve 912 will physically rotate the ball valve 904. In other embodiments, however, the sliding sleeve 912 may be operatively coupled to an actuator (not labelled) that is operable to rotate the ball valve 904 between the open and closed positions upon activation. More particularly, when the sliding sleeve 912 is moved axially within the completion string 128, such movement may trigger activation of the actuator, which operates to rotate the ball valve 904 between the open and closed positions. The actuator may be any type of actuator device including, but not limited to, a mechanical actuator, an electrical actuator, an electromechanical actuator, a hydraulic actuator, and a pneumatic actuator, without departing from the scope of the disclosure.

The service tool 138 may include a wash pipe 914 similar to the wash pipe 207 of FIGS. 2-4 arranged at a distal end of the service tool 138. A shifting tool assembly 916 may be coupled to or otherwise be included in the service tool 138 at or near the wash pipe 914. The shifting tool assembly 916 may be the same as or similar to the shifting tool assembly 140 of FIGS. 6A-6B and 7. More particularly, the shifting tool assembly 916 may include an elongate mandrel 918, a shifting tool 920, and one or more upper equalization seals 922. The shifting tool assembly 916 may further include a bull plug 924 positioned within the mandrel 918, and a friction or weep tube 926 that extends through the plug 924. As illustrated, the mandrel 918 may comprise two or more structural components. In other embodiments, however, the mandrel 918 may be an elongate, monolithic structure.

The shifting tool assembly 916 may be the same as or similar to the shifting tool assembly 140 of FIGS. 6A-6B and 7. More particularly, the shifting tool assembly 916 may include an elongate mandrel 918, a shifting tool 920, and one or more upper equalization seals 922. The shifting tool assembly 916 may further include a bull plug 924 positioned within the mandrel 918, and a friction or weep tube 926 that extends through the plug 924. As illustrated, the mandrel 918 may comprise two or more structural components. In other embodiments, however, the mandrel 918 may be an elongate, monolithic structure.

The shifting tool 920 may be similar to or the same as the shifting tool 618 of FIGS. 6A-6B and 7 in that the shifting tool 920 may be operatively coupled to the mandrel 918 and spring-loaded for radial movement relative thereto. More particularly, the shifting tool 920 may comprise a collet assembly that provides or otherwise defines one or more keys 928 having a shifter profile 930 defined on their outer radial surface. The shifter profile 930 may be configured to locate and engage a corresponding sleeve profile 932 defined on the inner radial surface of the sliding sleeve 912. The configuration and operation of the shifter profile 930 and the sleeve profile 932 may be the same as or similar to the configuration and operation of the shifter profile 624 and the sleeve profile 626 of FIGS. 6A-6B, and therefore will not be described again.

The upper equalization seals 922 may be axially spaced from each other along the mandrel 918 and configured to seal against the upper seal bore 902 as the shifting tool 920 engages the sliding sleeve 912 and shifts the ball valve 904 between the open and closed positions. The configuration and operation of the upper equalization seals 922 may be similar to or the same as the upper equalization seals 620*a* of FIGS. 6A-6B, and therefore will not be described again.

Exemplary operation of the shifting tool assembly 916 in closing the ball valve 904 is now provided. In FIG. 9A, the shifting tool assembly 916 is being pulled upwards in the uphole direction A relative to the completion string 128. As the shifting tool assembly 916 is pulled uphole A, the upper equalization seals 922 eventually come into contact with and seal against the upper seal bore 902 of the completion string 128. Prior to the upper equalization seals 922 engaging the upper seal bore 902, however, fluids (e.g., liquids, gases, or any combination thereof) from a surrounding formation (e.g., the subterranean formation 104 of FIG. 1) may be able to flow through and around the service tool 138 at a relatively high rate, such as in the case of production operations. More particularly, fluids may be able to flow through the weep tube 926 and also around the service tool 138 in the annulus defined between the service tool 138 and the completion string 128. One or more holes 934 (three shown) may be defined in the mandrel 918 uphole from the bull plug 924 to increase fluid flow rate at that point.

Once the upper equalization seals 922 begin to sealingly engage the upper seal bore 902, as shown in FIG. 9A, fluid flow around the service tool 138 in the annulus between the service tool 138 and the completion string 128 may cease, while a choked or metered amount (e.g., a limited volumetric rate in GPM) of fluid flow may continue to pass through the weep tube 926. As a result, a pressure differential may be generated across the upper equalization seals 922 as they assume the fluid flow pressure exhibited by the hydrostatic pressure of the completion string 128 or surrounding annulus as compared to the formation pressure (e.g., fluids derived from the surrounding subterranean formation 104 of FIG. 1).

In FIG. 9B, continued movement of the shifting tool assembly 916 in the uphole direction A may allow the shifting tool 920 to locate and engage the sliding sleeve 912. More particularly, the shifter profile 930 defined on the shifting tool 920 may locate and engage the sleeve profile 932, as illustrated. Continued movement of the shifting tool assembly 916 in the uphole direction A may correspondingly move the sliding sleeve 912 in the uphole direction A, which may correspondingly move the ball valve 904 from the open position, as shown in FIGS. 9A and 9B, to the closed position, as shown in FIG. 9C. While the ball valve 904 is being moved to the closed position, the upper equalization seals 922 may dynamically seal against the upper seal bore 902, thereby allowing the ball valve 904 to be closed while subjected to a reduced fluid pressure commensurate with the metered amount of fluid flow that flows through the weep tube 926. As a result, the primary seals 908 of the ball valve 904 may be protected from damage resulting from rapid pressure equalization that would otherwise occur by closing the ball valve 904 with an elevated flow rate of fluids flowing through the service tool 138. Instead, any seal damage resulting from rapid pressure equalization may be assumed by the upper equalization seals 922.

In FIG. 9C, the shifting tool assembly 916 has continued moving in the uphole direction A, and thereby fully actuating the ball valve 904 to the closed position where the primary seals 908 sealingly engage adjacent surfaces of the completion string 128. As the shifting tool assembly 916 continues moving in the uphole direction A, the shifting tool 920 may flex radially inward and thereby effectively disengage the shifting tool 920 from the sliding sleeve 912. Moreover, as the shifting tool assembly 916 continues moving in the uphole direction A, the upper equalization seals 922 will eventually move out of sealing engagement with the upper seal bore 902, which will transfer the pressure differential assumed by the upper equalization seals 922 to the ball valve 904 and its primary seals 908. In the event the upper equalization seals 922 sustained any damage by assuming the elevated pressure while closing the ball valve 904, the service tool 138 may be retrieved to the surface where the upper equalization seals 922 may be redressed, rehabilitated, or replaced, if necessary.

Embodiments disclosed herein include:

A. A downhole system that includes a completion string positionable within a wellbore and providing at least an upper seal bore and a downhole device arranged downhole from the upper seal bore, wherein the downhole device provides a sliding sleeve, a service tool extendable within the completion string, and a shifting tool assembly coupled to the service tool and including a mandrel, a shifting tool coupled to the mandrel, and one or more upper equalization seals arranged on the mandrel and sealingly engageable with the upper seal bore, wherein the shifting tool is engageable with the sliding sleeve to move the downhole device at least partially between a closed position, where a pressure differential between a subterranean formation and an interior of the completion string is assumed by primary sealing elements of the downhole device, and an open position, where the pressure differential is assumed by at least the one or more upper equalization seals, and wherein the pressure differential is assumed by at least the one or more upper equalization seals while the downhole device is moved between the closed and open positions.

B. A method that includes introducing a service tool into a wellbore, the wellbore having a completion string positioned therein that provides at least an upper seal bore and a downhole device, wherein the downhole device is arranged downhole from the upper seal bore and includes a sliding sleeve, extending the service tool at least partially into the completion string, the service tool providing a shifting tool assembly that includes a mandrel, a shifting tool coupled to the mandrel, and one or more upper equalization seals arranged on the mandrel uphole from the shifting tool, sealingly engaging the one or more upper equalization seals on the upper seal bore, engaging the shifting tool on the sliding sleeve to move the downhole device at least partially between a closed position, where a pressure differential between a subterranean formation and an interior of the completion string is assumed by primary sealing elements of the downhole device, and an open position, where the pressure differential is assumed by at least the one or more upper equalization seals, and assuming the pressure differential by at least the one or more upper equalization seals while the downhole device is moving between the closed and open positions.

Each of embodiments A and B may have one or more of the following additional elements in any combination: Element 1: wherein the downhole device is the sliding sleeve and the downhole system further comprises a lower seal bore provided by the completion string and axially offset from the upper seal bore, wherein the sliding sleeve is axially positioned between the upper and lower seal bores, one or more flow ports defined in the completion string at the sliding sleeve to place the subterranean formation in fluid communication with the interior, wherein the sliding sleeve occludes the one or more flow ports when in the closed position, and one or more lower equalization seals arranged on the mandrel and sealingly engageable with the lower seal bore. Element 2: wherein the one or more upper equalization seals are axially spaced from the one or more lower equalization seals such that each is able to simultaneously seal against the upper and lower seal bores, respectively, while the shifting tool moves the sliding sleeve between the open and closed positions. Element 3: wherein a differentially isolated chamber is defined between the completion string and the service tool when the upper and lower equalization seals sealingly engage the upper and lower seal bores, respectively, and wherein the sliding sleeve is arranged in the differentially isolated chamber. Element 4: wherein the shifting tool assembly further includes a choke defined through the mandrel and arranged axially between the upper and lower equalization seals, the choke being in fluid communication with the differentially isolated chamber and configured to dissipate the pressure differential by allowing a metered amount of the fluid out of the differentially isolated chamber. Element 5: wherein the one or more lower equalization seals comprise a first set of lower equalization seals and a second set of equalization seals axially spaced from the first set of equalization seals on the mandrel, and wherein the shifting tool assembly further includes a choke defined through the mandrel and arranged axially between the first and second sets of lower equalization seals, the choke being configured to dissipate the pressure differential by allowing a metered amount of the fluid out of the differentially isolated chamber when the first set of lower equalization seals moves out of sealed engagement with the lower seal bore. Element 6: wherein the upper and lower equalization seals are axially spaced from each other such that, while moving the shifting tool assembly with respect to the completion string, the one or more lower equalization seals sealingly engage the lower seal bore prior to the one or more upper equalization seals sealingly engaging the upper seal bore. Element 7: wherein a differentially isolated chamber is defined by the service tool and the completion string when the one or more lower equalization seals sealingly engage the lower seal bore, and wherein the differentially isolated chamber is at least partially filled with a fluid to minimize a volume required to be equalized across the sliding sleeve as the sliding sleeve moves between the closed and open positions. Element 8: wherein the one or more upper and lower equalization seals comprise a seal selected from the group consisting of a baffle seal, a seal ring, and a one-way seal. Element 9: wherein the downhole device is a ball valve and the sliding sleeve is operatively coupled to the ball valve such that movement of the sliding sleeve within the completion string correspondingly moves the ball valve between the open and closed positions. Element 10: wherein the shifting tool assembly further includes a bull plug positioned within the mandrel and a weep tube that extends through the bull plug to provide fluid communication through the bull plug, and wherein the weep tube dissipates the pressure differential by allowing a metered amount of the fluid to bypass the bull plug when the one or more upper equalization seals sealingly engage the upper seal bore. Element 11: wherein the one or more upper equalization seals comprise a seal selected from the group consisting of a baffle seal, a seal ring, and a one-way seal.

Element 12: wherein the downhole device is the sliding sleeve and a lower seal bore is provided by the completion string and axially offset from the upper seal bore, the sliding sleeve being positioned between the upper and lower seal bores, and one or more lower equalization seals provided on the mandrel and sealingly engageable with the lower seal bore, the method further comprising occluding one or more flow ports defined in the completion string with the sliding sleeve when the sliding sleeve is in the closed position, the one or more flow ports placing the subterranean formation in fluid communication with the interior when the sliding sleeve is in the open position. Element 13: wherein the upper and lower equalization seals are axially spaced from each other on the mandrel, the method further comprising moving the sliding sleeve between the open and closed positions with the shifting tool, and simultaneously sealing against the upper and lower seal bores with the upper and lower equalization seals, respectively, as the sliding sleeve is moved between the open and closed positions. Element 14: wherein a differentially isolated chamber is defined between the completion string and the service tool when the upper and lower equalization seals sealingly engage the upper and lower seal bores, respectively, the method further comprising ceasing fluid flow through the one or more flow ports when the upper and lower seal bores are sealingly engaged with the upper and lower equalization seals, respectively, and assuming the pressure differential with the upper and lower equalization seals while the sliding sleeve is moved between the closed and open positions. Element 15: wherein the shifting tool assembly further includes a choke defined in the mandrel and arranged axially between the upper and lower equalization seals and in fluid communication with the differentially isolated chamber, the method further comprising allowing a metered amount of the fluid out of the differentially isolated chamber via the choke, and dissipating the pressure differential with the choke. Element 16: further comprising monitoring a pressure differential between the differentially isolated chamber and the interior with a pressure monitoring device. Element 17: wherein the upper and lower equalization seals comprise one-way seals, the method further comprising injecting a fluid into the differentially isolated chamber across the one of the upper and lower equalization seals in a first direction preventing the fluid from migrating across the one of the upper and lower equalization seals in a second direction opposite the first direction, and filling the differentially isolated chamber at least partially with the fluid and thereby minimizing a volume required to be equalized across the sliding sleeve as the sliding sleeve moves between the closed and open positions. Element 18: wherein the one or more lower equalization seals comprise a first set of lower equalization seals and a second set of lower equalization seals axially spaced from the first set of lower equalization seals, the method further comprising moving the first set of lower equalization seals out of sealed engagement with the lower seal bore, allowing a metered amount of the fluid out of the differentially isolated chamber via a choke defined in the mandrel and arranged axially between the first and second sets of lower equalization seals, and dissipating the pressure differential with the choke. Element 19: wherein sealingly engaging the one or more upper equalization seals on the upper seal bore is preceded by moving the shifting tool assembly with respect to the completion string, and sealingly engaging the lower seal bore with the one or more lower equalization seals, wherein a differentially isolated chamber is defined by the service tool and the completion string when the one or more lower equalization seals sealingly engage the lower seal bore, and filling the differentially isolated chamber at least partially with a fluid and thereby minimizing a volume required to be equalized across the sliding sleeve as the sliding sleeve moves between the closed and open positions. Element 20: further comprising retrieving the service tool to a surface location, and redressing, rehabilitating, or replacing the one or more upper and lower equalization seals upon returning the service tool to the surface location. Element 21: wherein the downhole device is a ball valve and the sliding sleeve is operatively coupled to the ball valve, and the shifting tool assembly further includes a bull plug positioned within the mandrel and a weep tube that extends through the bull plug to facilitate fluid communication through the bull plug, the method further comprising moving the sliding sleeve within the completion string with the shifting tool and thereby correspondingly moving the ball valve between the open and closed positions, allowing a metered amount of the fluid to bypass the bull plug via the weep tube; and dissipating the pressure differential with the weep tube. Element 22: further comprising retrieving the service tool to a surface location, and redressing, rehabilitating, or replacing the one or more upper equalization seals upon returning the service tool to the surface location.

By way of non-limiting example, exemplary combinations applicable to A, B, and C include: Element 1 with Element 2; Element 2 with Element 3; Element 3 with Element 4; Element 3 with Element 5; Element 1 with Element 6; Element 6 with Element 7; Element 1 with Element 8; Element 9 with Element 10; Element 9 with Element 11; Element 12 with Element 13; Element 13 with Element 14; Element 14 with Element 15; Element 15 with Element 16; Element 14 with Element 17; Element 15 with Element 18; Element 12 with Element 19; Element 12 with Element 20; and Element 21 with Element 22.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

The use of directional terms such as above, below, upper, lower, upward, downward, left, right, uphole, downhole and the like are used in relation to the illustrative embodiments as they are depicted in the figures. For instance, the upward or uphole direction is toward the surface of the well, and the downward or downhole direction is toward the toe of the well.

What is claimed is:

1. A downhole system, comprising:

a completion string positionable within a wellbore and providing at least an upper seal bore, a lower seal bore axially offset from the upper seal bore, and a downhole device arranged downhole from the upper seal bore, wherein the downhole device provides a sliding sleeve;

a service tool extendable within the completion string; and a shifting tool assembly coupled to the service tool and including a mandrel, a shifting tool coupled to the mandrel, one or more upper equalization seals arranged on the mandrel and configured to be sealably disposed within the upper seal bore, and one or more lower equalization seals arranged on the mandrel and configured to be sealably disposed within the lower seal bore, wherein the shifting tool is engageable with the sliding sleeve to move the downhole device at least partially between a closed position, where a pressure differential between a subterranean formation and an interior of the completion string is borne by primary sealing elements of the downhole device, and an open position, where the pressure differential is borne by at least the one or more upper equalization seals, wherein the pressure differential is borne by at least the one or more upper equalization seals while the downhole device is moved between the closed and open positions, and wherein a differentially isolated chamber is defined between the completion string and the service tool when the upper and lower equalization seals are sealingly disposed in the upper and lower seal bores.

2. The downhole system of claim 1, wherein the downhole device is the sliding sleeve and the downhole system further comprises:

one or more flow ports defined in the completion string at the sliding sleeve to place the subterranean formation in fluid communication with the interior, wherein the sliding sleeve occludes the one or more flow ports when in the closed position, wherein the lower seal bore is provided by the completion string, and the sliding sleeve is axially positioned between the upper and lower seal bores.

3. The downhole system of claim 2, wherein the one or more upper equalization seals are axially spaced from the one or more lower equalization seals such that each of the one or more upper equalization seals and each of the one or more lower equalization seals is able to simultaneously seal against the upper and lower seal bores, respectively, while the shifting tool moves the sliding sleeve between the open and closed positions.

4. The downhole system of claim 3, wherein the sliding sleeve is arranged in the differentially isolated chamber.

5. The downhole system of claim 4, wherein the shifting tool assembly further includes a choke defined through the mandrel and arranged axially between the upper and lower equalization seals, the choke being in fluid communication with the differentially isolated chamber and configured to dissipate the pressure differential by allowing a metered amount of fluid out of the differentially isolated chamber.

6. The downhole system of claim 4, wherein the one or more lower equalization seals comprise a first set of lower equalization seals and a second set of equalization seals axially spaced from the first set of lower equalization seals on the mandrel, and wherein the shifting tool assembly further includes a choke defined through the mandrel and arranged axially between the first and second sets of lower equalization seals, the choke being configured to dissipate the pressure differential by allowing a metered amount of the fluid out of the differentially isolated chamber when the first set of lower equalization seals moves out of sealed engagement with the lower seal bore.

7. The downhole system of claim 2, wherein the upper and lower equalization seals are axially spaced from each other such that, while moving the shifting tool assembly with respect to the completion string, the one or more lower equalization seals sealingly engage the lower seal bore prior to the one or more upper equalization seals sealingly engaging the upper seal bore.

8. The downhole system of claim 7, wherein a differentially isolated chamber is defined by the service tool and the completion string when the one or more lower equalization seals sealingly engage the lower seal bore, and wherein the differentially isolated chamber is at least partially filled with a fluid to minimize a volume required to be equalized across the sliding sleeve as the sliding sleeve moves between the closed and open positions.

9. The downhole system of claim 2, wherein each of the one or more upper and lower equalization seals comprises a seal selected from the group consisting of a baffle seal, a seal ring, and a one-way seal.

10. The downhole system of claim 1, wherein the downhole device is a ball valve and the sliding sleeve is operatively coupled to the ball valve such that movement of the sliding sleeve within the completion string correspondingly moves the ball valve between the open and closed positions.

11. The downhole system of claim 10, wherein the shifting tool assembly further includes a bull plug positioned within the mandrel and a weep tube that extends through the bull plug to provide fluid communication through the bull plug, and wherein the weep tube dissipates the pressure differential by allowing a metered amount of the fluid to bypass the bull plug when the one or more upper equalization seals sealingly engage the upper seal bore.

12. The downhole system of claim 10, wherein the one or more upper equalization seals comprise a seal selected from the group consisting of a baffle seal, a seal ring, and a one-way seal.

13. A method, comprising:

introducing a service tool into a wellbore, the wellbore having a completion string positioned therein that provides at least an upper seal bore, a lower seal bore axially offset from the upper seal bore, and a downhole device, wherein the downhole device is arranged downhole from the upper seal bore and includes a sliding sleeve;

extending the service tool at least partially into the completion string, the service tool providing a shifting tool assembly that includes a mandrel, a shifting tool coupled to the mandrel, one or more upper equalization seals arranged on the mandrel uphole from the shifting tool, and one or more lower equalization seals arranged on the mandrel and configured to be sealably disposed within the lower seal bore;

sealingly disposing the one or more upper equalization seals and the one or more lower equalization seals on the respective upper seal bore and lower seal bore, wherein a differentially isolated chamber is defined between the completion string and the service tool upon sealingly disposing the upper and lower equalization seals within the upper and lower seal bores, respectively;

engaging the shifting tool on the sliding sleeve to move the downhole device at least partially between a closed position, where a pressure differential between a subterranean formation and an interior of the completion string is borne by primary sealing elements of the downhole device, and an open position, where the pressure differential is borne by at least the one or more upper equalization seals; and bearing the pressure differential by at least the one or more upper equalization seals while the downhole device is moving between the closed and open positions.

14. The method of claim 13, wherein the downhole device is the sliding sleeve and the lower seal bore is provided by the completion string, the sliding sleeve being positioned between the upper and lower seal bores, the method further comprising:

occluding one or more flow ports defined in the completion string with the sliding sleeve upon placing the sliding sleeve to the closed position, the one or more flow ports placing the subterranean formation in fluid communication with the interior upon placing the sliding sleeve in the open position.

15. The method of claim 14, wherein the upper and lower equalization seals are axially spaced from each other on the mandrel, the method further comprising:

moving the sliding sleeve between the open and closed positions with the shifting tool; and simultaneously sealing against the upper and lower seal bores with the upper and lower equalization seals, respectively, as the sliding sleeve is moved between the open and closed positions.

16. The method of claim 15, further comprising:

ceasing fluid flow through the one or more flow ports upon sealingly disposing the upper and lower seal bores within the upper and lower equalization seals, respectively; and bearing the pressure differential with the upper and lower equalization seals while the sliding sleeve is moved between the closed and open positions.

17. The method of claim 16, wherein the shifting tool assembly further includes a choke defined in the mandrel and arranged axially between the upper and lower equalization seals and in fluid communication with the differentially isolated chamber, the method further comprising:

allowing a metered amount of the fluid out of the differentially isolated chamber via the choke; and dissipating the pressure differential with the choke.

18. The method of claim 17, further comprising monitoring a pressure differential between the differentially isolated chamber and the interior with a pressure monitoring device.

19. The method of claim 16, wherein the upper and lower equalization seals comprise one-way seals, the method further comprising:

injecting a fluid into the differentially isolated chamber across the one of the upper and lower equalization seals in a first direction;

preventing the fluid from migrating across the one of the upper and lower equalization seals in a second direction opposite the first direction; and filling the differentially isolated chamber at least partially with the fluid and thereby minimizing a volume required to be equalized across the sliding sleeve as the sliding sleeve moves between the closed and open positions.

20. The method of claim 16, wherein the one or more lower equalization seals comprise a first set of lower equalization seals and a second set of lower equalization seals axially spaced from the first set of lower equalization seals, the method further comprising:

moving the first set of lower equalization seals out of sealed engagement with the lower seal bore;

allowing a metered amount of the fluid out of the differentially isolated chamber via a choke defined in the mandrel and arranged axially between the first and second sets of lower equalization seals; and dissipating the pressure differential with the choke.

21. The method of claim 14, wherein sealingly disposing the one or more upper equalization seals on the upper seal bore is preceded by:

moving the shifting tool assembly with respect to the completion string; and sealingly disposing the lower seal bore with the one or more lower equalization seals; and filling the differentially isolated chamber at least partially with a fluid and thereby minimizing a volume required to be equalized across the sliding sleeve as the sliding sleeve moves between the closed and open positions.

22. The method of claim 14, further comprising:

retrieving the service tool to a surface location; and redressing, rehabilitating, or replacing the one or more upper and lower equalization seals upon returning the service tool to the surface location.

23. The method of claim 13, wherein the downhole device is a ball valve and the sliding sleeve is operatively coupled to the ball valve, and the shifting tool assembly further includes a bull plug positioned within the mandrel and a weep tube that extends through the bull plug to facilitate fluid communication through the bull plug, the method further comprising:

moving the sliding sleeve within the completion string with the shifting tool and thereby correspondingly moving the ball valve between the open and closed positions;

allowing a metered amount of the fluid to bypass the bull plug via the weep tube; and dissipating the pressure differential with the weep tube.

24. The method of claim 23, further comprising:

retrieving the service tool to a surface location; and redressing, rehabilitating, or replacing the one or more upper equalization seals upon returning the service tool to the surface location.

* * * * *